US009269282B1

(12) United States Patent
Hartman

(10) Patent No.: US 9,269,282 B1
(45) Date of Patent: Feb. 23, 2016

(54) SIGN POST AND SIGN SYSTEM

(71) Applicant: Jeffrey K. Hartman, Bettendorf, IA (US)

(72) Inventor: Jeffrey K. Hartman, Bettendorf, IA (US)

( * ) Notice: Subject to any disclaimer, the term of this patent is extended or adjusted under 35 U.S.C. 154(b) by 0 days.

(21) Appl. No.: 14/475,565

(22) Filed: Sep. 2, 2014

Related U.S. Application Data

(60) Provisional application No. 61/872,413, filed on Aug. 30, 2013.

(51) Int. Cl.
*G09F 7/22* (2006.01)
*G09F 13/02* (2006.01)
*G09F 15/00* (2006.01)

(52) U.S. Cl.
CPC *G09F 7/22* (2013.01); *G09F 13/02* (2013.01); *G09F 15/0037* (2013.01)

(58) Field of Classification Search
CPC ..... G09F 7/18; G09F 7/22; G09F 15/0006; G09F 15/0037; E01F 9/0117
See application file for complete search history.

(56) References Cited

U.S. PATENT DOCUMENTS

| | | | | |
|---|---|---|---|---|
| 2,142,200 | A * | 1/1939 | Marshall | G09F 7/02 40/585 |
| 4,910,901 | A * | 3/1990 | Boyar | G09F 7/22 40/606.19 |
| 5,400,535 | A * | 3/1995 | Schomaker | G09F 7/18 40/606.19 |
| 7,389,603 | B1 * | 6/2008 | Brumfield | A45F 3/44 173/91 |
| 2006/0080876 | A1 * | 4/2006 | Carter | G09F 7/18 40/607.09 |
| 2006/0101690 | A1 * | 5/2006 | Terbet, Jr. | G09F 15/0006 40/607.09 |
| 2008/0149786 | A1 * | 6/2008 | Bradley | E04H 12/2253 248/121 |

* cited by examiner

*Primary Examiner* — Casandra Davis
(74) *Attorney, Agent, or Firm* — Hamilton IP Law, PC; Jay R. Hamilton; Charles A. Damschen

(57) ABSTRACT

A sign post and sign system comprising a base may be connected to a vertical post. A four-way connector may attach horizontal stems to the vertical post. Rotatable or non-rotatable fasteners may be positioned on the upper or lower side of the horizontal stems. Rotatable fasteners may be connected to the horizontal stems to support rotation of a connected sign in an axis parallel to the horizontal stems. A one piece or two-piece cap design may be connected to the four-way connector. Lights, wiring, batteries, and/or a solar panel may be integrated into the sign system. A sign may be attached between the vertical post and the horizontal post to support rotation of the connected sign in an axis parallel to the vertical post. Rotatable fasteners may be connected to the horizontal stems to support rotation of a connected sign in an axis parallel to the horizontal stems.

21 Claims, 53 Drawing Sheets

SIGN POST AND SIGN SYSTEM

CROSS REFERENCE TO RELATED APPLICATIONS

Applicant claims priority from U.S. Provisional Pat. App. No. 61/872,413 filed on Aug. 30, 2014, which is incorporated by reference herein in its entirety.

FIELD OF THE INVENTION

The present invention relates to a sign post and sign system. More specifically, the invention relates to pre-fabricated sign posts, such as those employed for yard sales or for real estate sale signs.

STATEMENT REGARDING FEDERALLY SPONSORED RESEARCH OR DEVELOPMENT

No federal funds were used to develop or create the invention disclosed and described in the patent application.

REFERENCE TO SEQUENCE LISTING, A TABLE, OR A COMPUTER PROGRAM LISTING COMPACT DISK APPENDIX

Not Applicable.

AUTHORIZATION PURSUANT TO 37 C.F.R. §1.171 (d)(c)

A portion of the disclosure of this patent document may contain material that is subject to copyright and trademark protection. The copyright owner has no objection to the facsimile reproduction by anyone of the patent document or the patent disclosure, as it appears in the Patent and Trademark Office patent file or records, but otherwise reserves all copyrights whatsoever.

DETAILED DESCRIPTION

Figure 1:
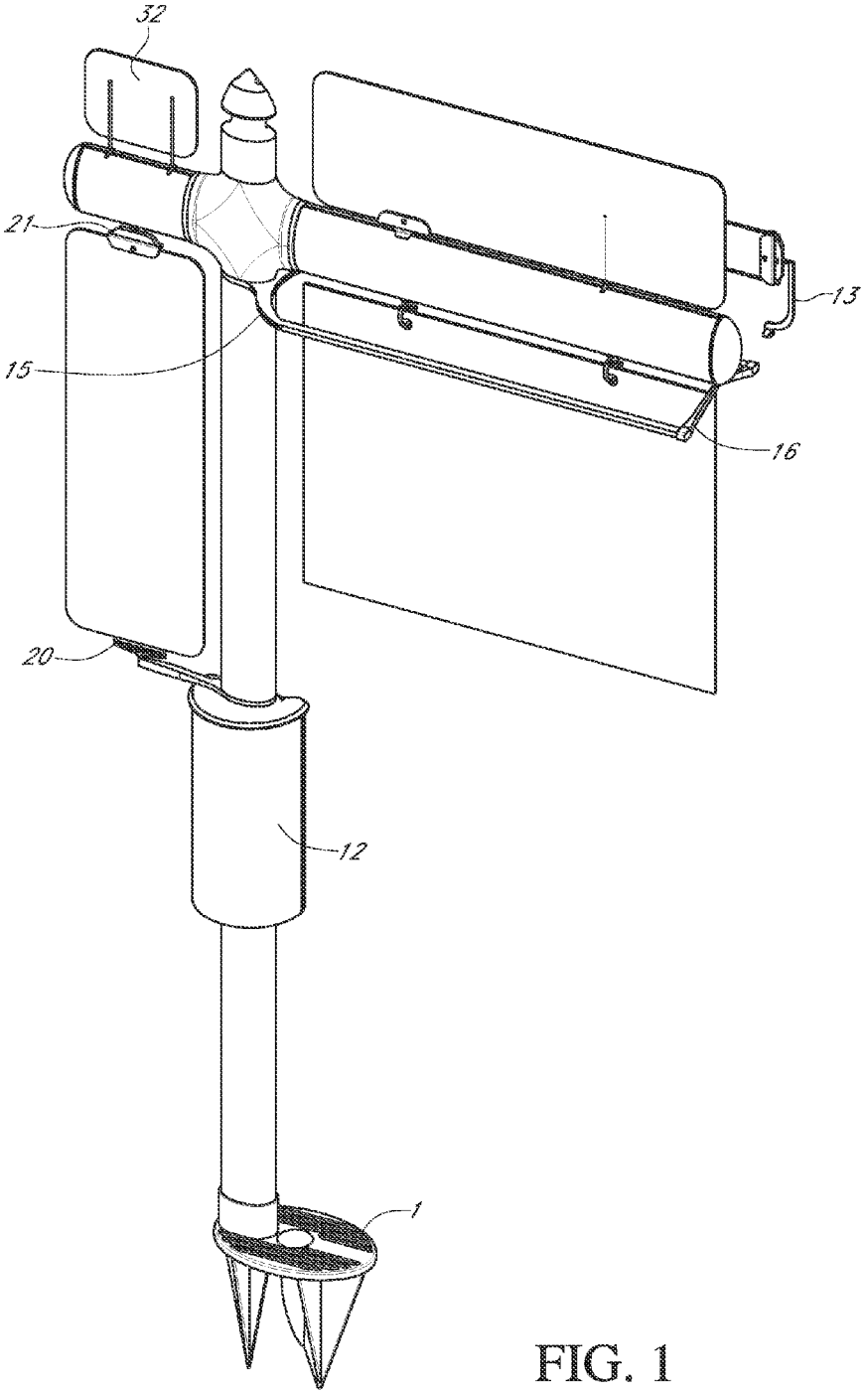
FIG. 1 is a perspective view of the front side of one embodiment of the sign post and sign system described herein.
Figure 1A:
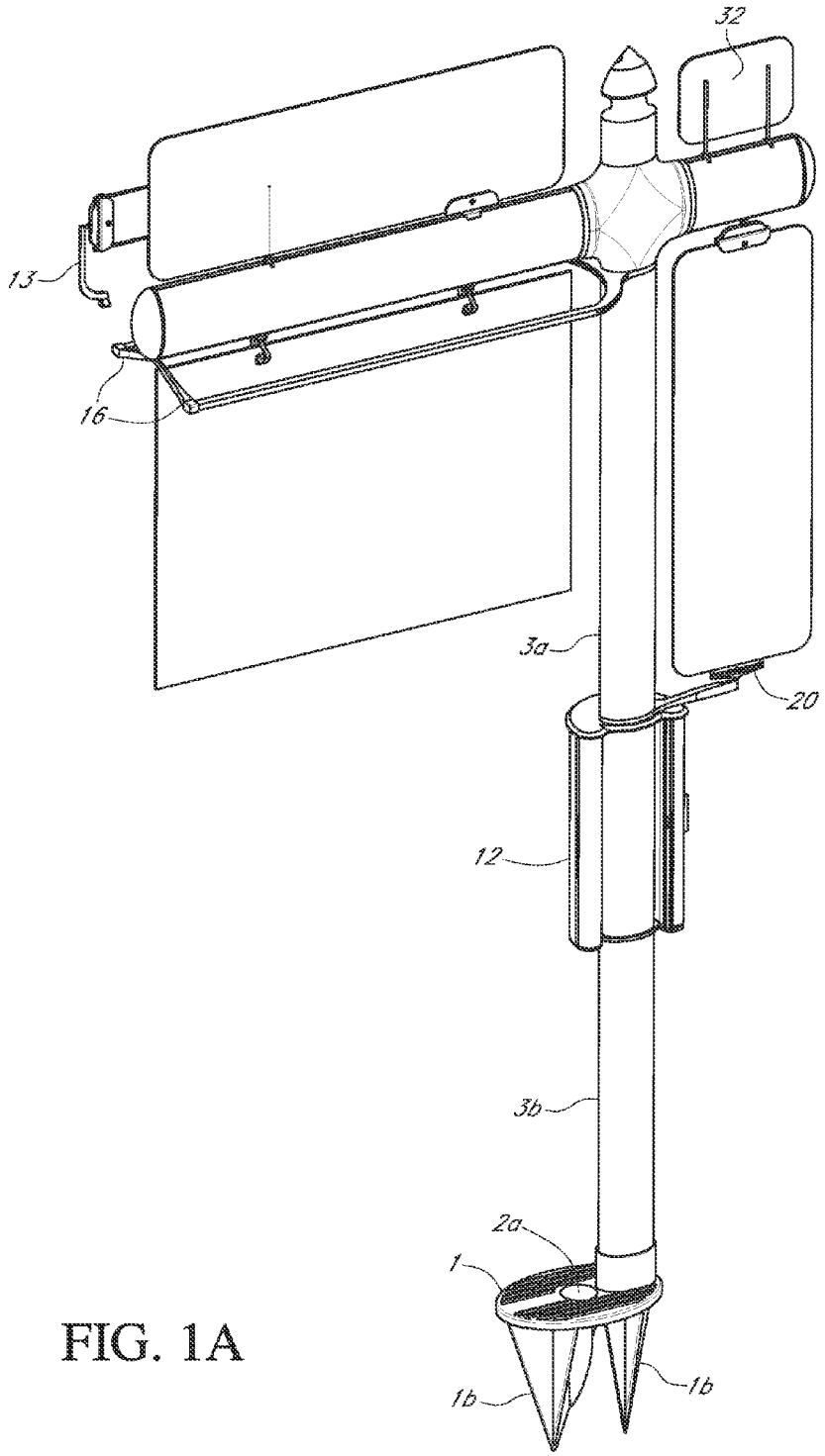
FIG. 1A is a rear perspective view of the sign post and sign system of FIG. 1.
Figure 1B:
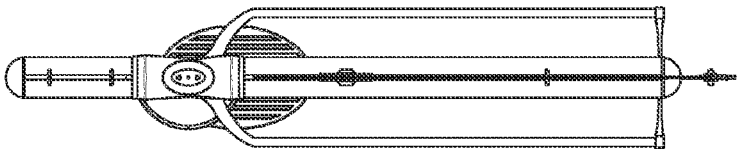
FIG. 1B is a top view of the sign post and sign system of FIG. 1 described herein.
Figure 1C:
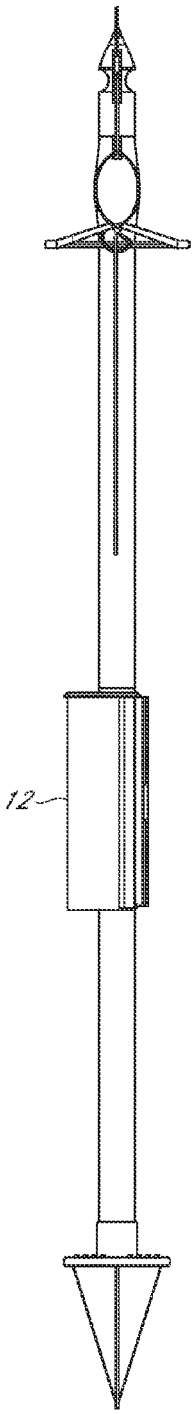
FIG. 1C is a side view of the sign post and sign system of FIG. 1.
Figure 1D:
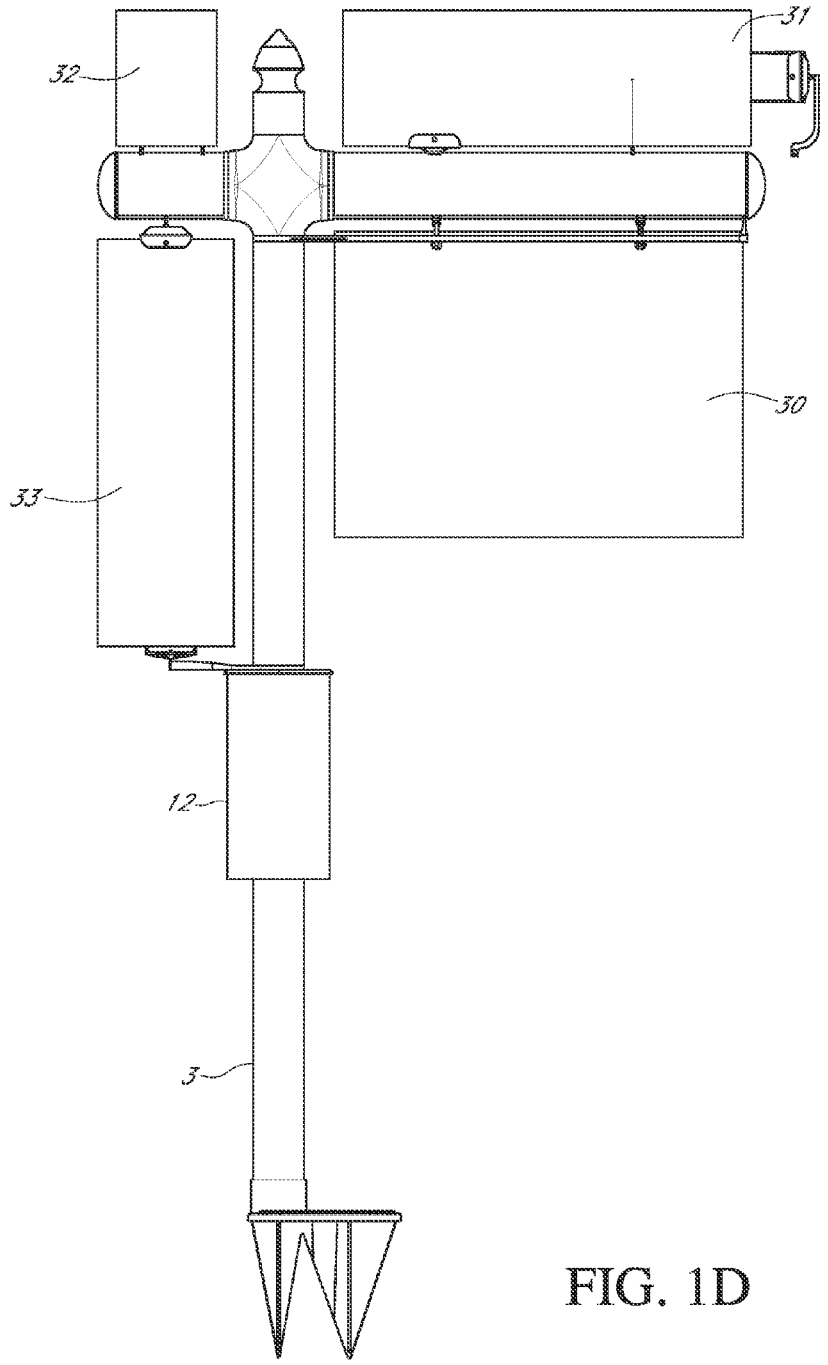
FIG. 1D is a front view of the sign post and sign system of FIG. 1.

Appendix A is included herein with additional drawings and fabrication guides to fully enable the present disclosure and is fully incorporated by reference herein.

DETAILED DESCRIPTION - LISTING OF ELEMENTS

| Element Description | Element Number |
|---|---|
| Base | 1 |
| Upper portion (base) | 1a |
| Lower portion (base) | 1b |
| Top (base) | 1c |
| Annular ridge | 1d |
| Cap (Base) | 2 |
| Aperture | 2a |
| Spike guide | 2b |
| Vertical Post | 3 |
| Upper portion | 3a |
| Lower portion | 3b |
| Vertical Connector | 4 |
| Guide | 5 |
| Connector (Four Way) | 6 |
| Anterior connection stub | 6a |
| Posterior connection stub | 6b |
| Upper connection stub | 6c |
| Lower connection stub | 6d |
| Stem cap | 7 |
| Horizontal stem | 8 |
| Anterior stem (longer) | 8a |
| Posterior stem (shorter) | 8b |
| Channel | 9 |
| Sign Hook | 10 |
| Rider pin (non-rotatable) | 11 |
| Flyer box assembly | 12 |
| Flyer box assembly - top | 12a |
| Flyer box assembly - bottom | 12b |
| Flyer box assembly - opening | 12c |
| Spinner rider clip | 13 |
| Spinner rider clip - first end | 13a |
| Spinner rider clip - arm | 13b |
| Spinner rider clip - shaft | 13c |
| Spinner rider clip - second end | 13d |
| Rail end | 14 |
| Center | 14a |
| Base | 14b |
| Support ridge | 14c |
| Shaft | 14d |
| Light fork | 15 |
| Light fork - vertical post receiver | 15a |
| Light fork - base | 15b |
| Light fork - arms | 15c |
| Light fork - wire channels | 15d |
| Light fork - LEDS | 15e |
| Light fork stabilizer | 16 |
| Light fork stabilizer - mounting tabs | 16a |
| Light fork stabilizer - legs | 16b |
| Light fork stabilizer - channels | 16c |
| Bottom spinner support | 17 |
| Bottom spinner support - vertical connector receiver | 17a |
| Bottom spinner support - arm | 17b |
| Bottom spinner support - shaft | 17c |
| Rider pin | 18 |
| Shaft | 18a |
| Washer | 19 |
| Spinner (pin configuration) | 20 |
| Spinner - base | 20a |
| Spinner - pins | 20b |
| Spinner - receiver | 20c |
| Spinner (clip configuration) | 21 |
| Spinner - base | 21a |
| Spinner - sidewalls | 21b |
| Spinner - engagement area | 21c |
| Spinner - receiver | 21d |
| Spinner - aperture | 21e |
| | 22 |
| Connector cap | 23 |
| Connector cap - top | 23a |
| Connector cap - bottom | 23b |
| Connector cap - interface | 23c |

-continued

| DETAILED DESCRIPTION - LISTING OF ELEMENTS | |
|---|---|
| Element Description | Element Number |
| Connector cap - locking ridges | 23d |
| Spinner rider pin (Horizontal) | 24 |
| Support surface (ground) | 25 |
| Vertical post | 26 |
| | 29 |
| Sign - position 1 | 30 |
| Sign - position 2 | 31 |
| Sign - position 3 | 32 |
| Sign - position 4 | 33 |
| | 34 |
| Flyer box back side | 45 |
| Flyer box front side | 46 |
| Flyer box door | 47 |
| Hammer plate | 50 |
| Hammer boot | 51 |
| Sign post and sign system | 100 |

DETAILED DESCRIPTION OF INVENTION

Before the various embodiments of the present invention are explained in detail, it is to be understood that the invention is not limited in its application to the details of construction and the arrangements of components set forth in the following description. The invention is capable of other embodiments and of being practiced or of being carried out in various ways. Also, it is to be understood that phraseology and terminology used herein with reference to device or element orientation (such as, for example, terms like "front", "back", "up", "down", "top", "bottom", and the like) are only used to simplify description of the present invention, and do not alone indicate or imply that the device or element referred to must have a particular orientation. In addition, terms such as "first", "second", and "third" are used herein and in the appended claims for purposes of description and are not intended to indicate or imply relative importance or significance.

The following detailed description is of the best currently contemplated modes of carrying out illustrative embodiments of the invention. The description is not to be taken in a limiting sense, but is made merely for the purpose of illustrating the general principles of the invention, since the scope of the invention is best defined by the appending claims. Various inventive features are described below herein that can each be used independently of one another or in combination with other features.

DETAILED DESCRIPTION OF THE INVENTION

Figure 2:
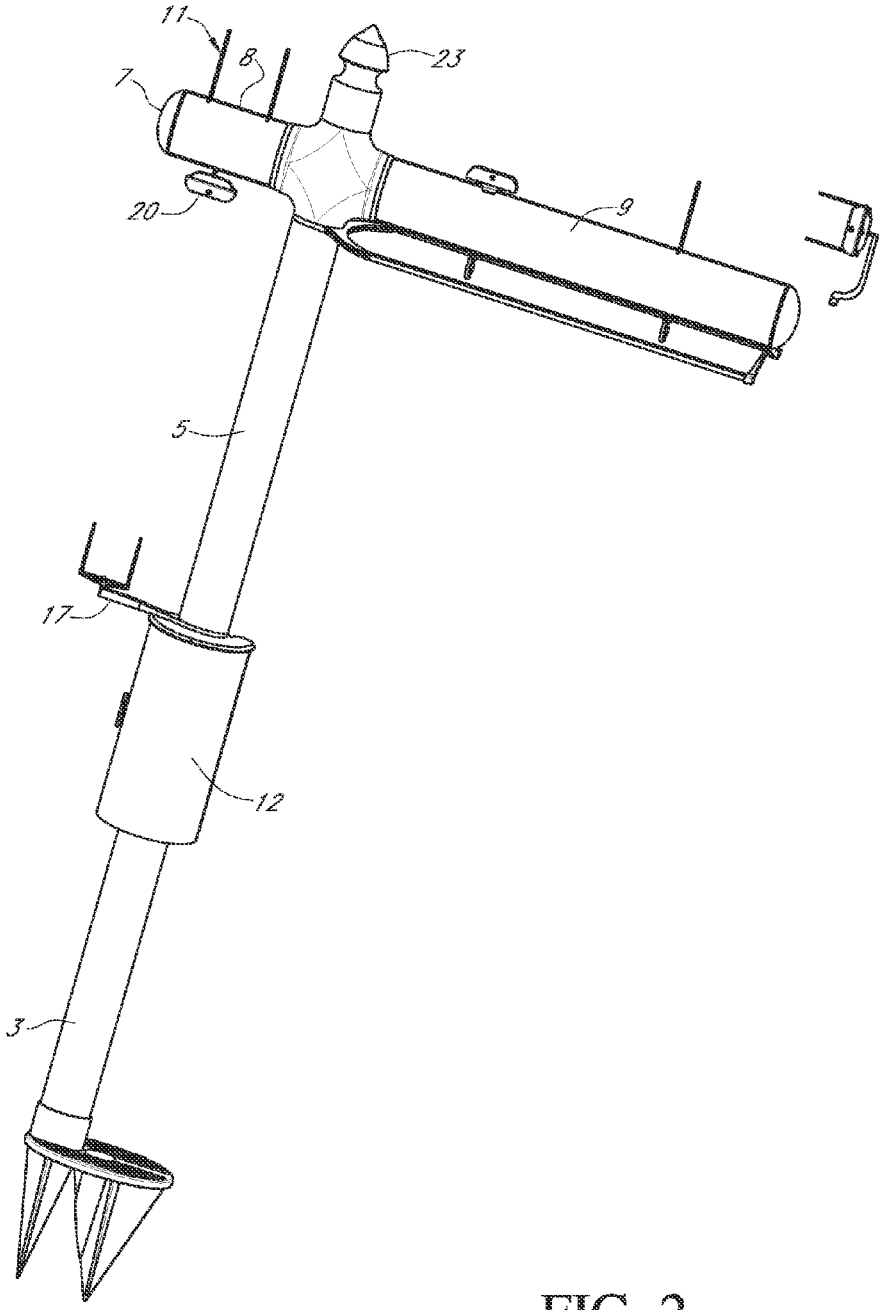
FIG. 2 is a perspective view of the front side of the sign post and sign system of FIG. 1 described herein with its various signs and placards removed.
Figure 3:
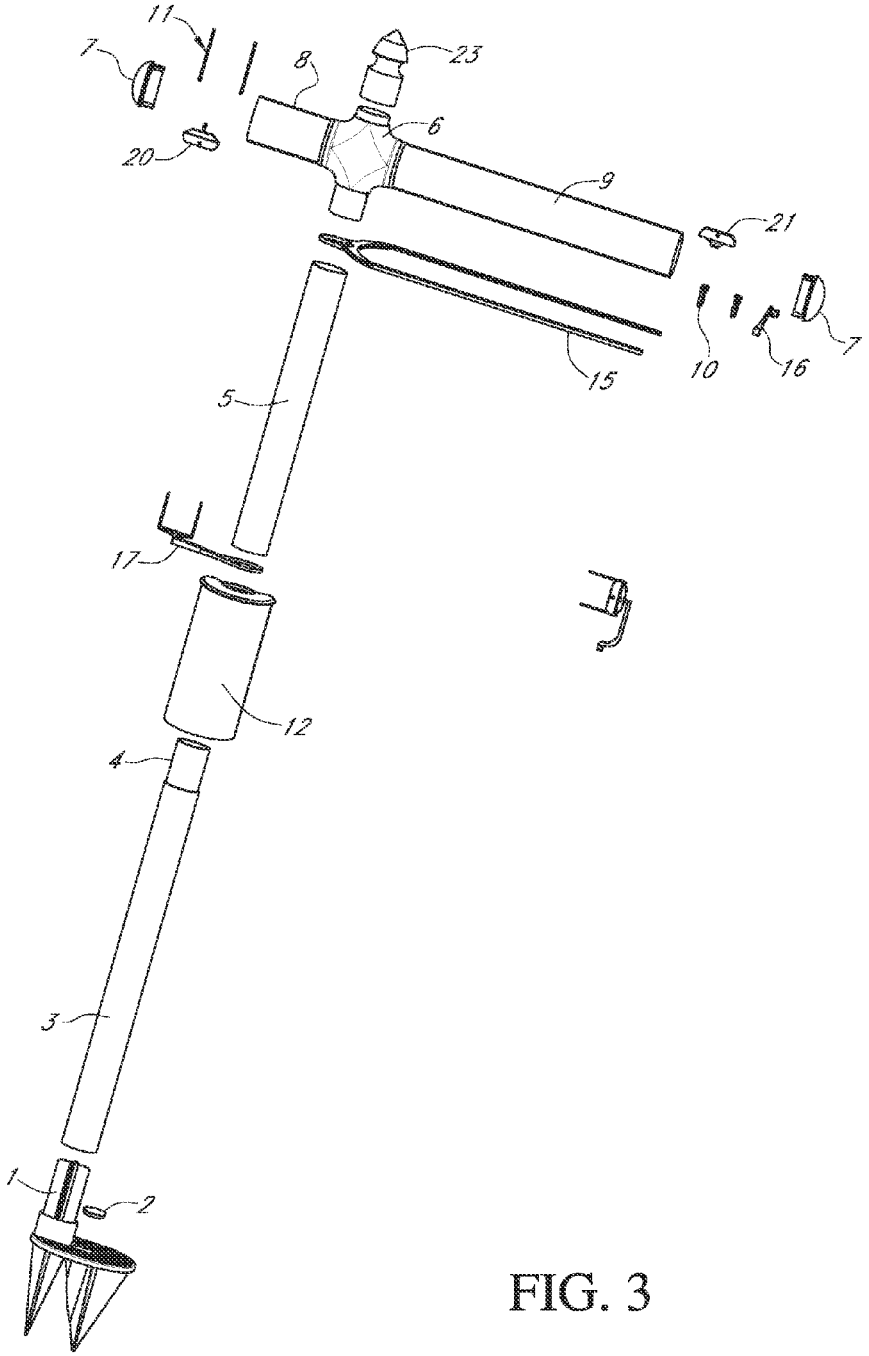
FIG. 3 is an exploded view of FIG. 2 described herein.

Referring now to the drawings, wherein like reference numerals designate identical or corresponding parts throughout the several views, FIGS. 1-3 generally show the sign post and sign system 100 of this disclosure as described and claimed.

Figure 4:
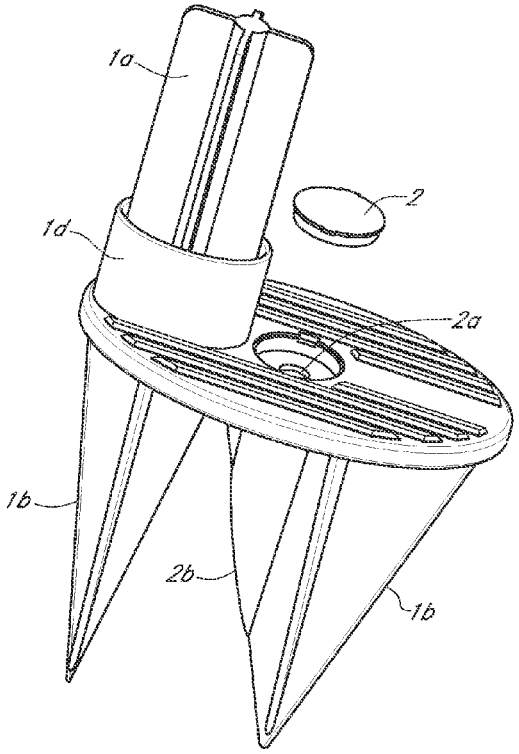
FIG. 4 is a perspective view of the base of one embodiment of the sign post and sign system described herein.
Figure 4A:
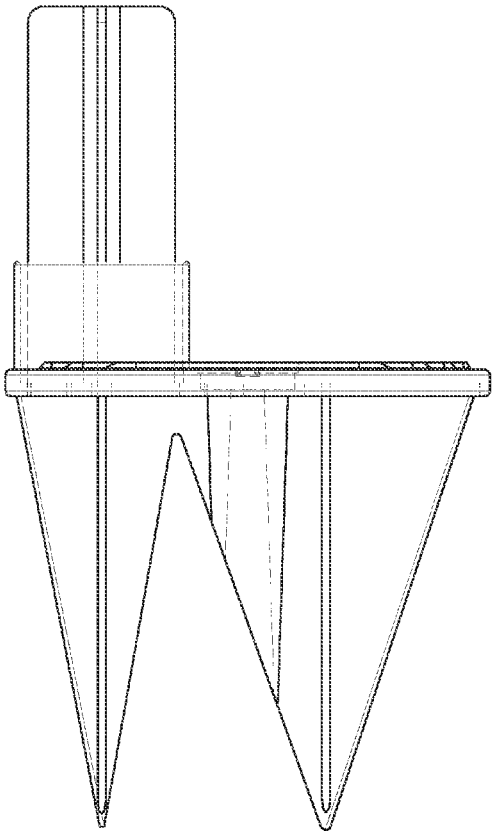
FIG. 4A is a side view of the base of FIG. 4 described herein.
Figure 4B:
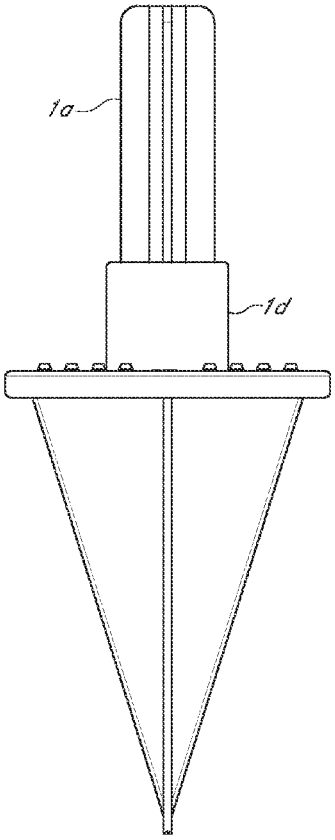
FIG. 4B is a front view of the base of FIG. 4 described herein.
Figure 4C:
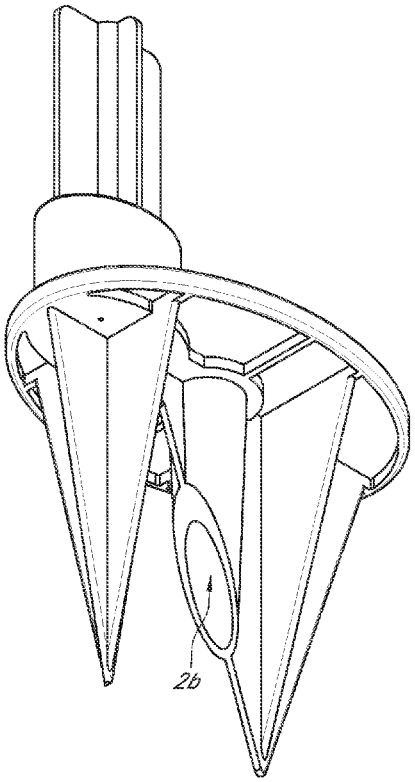
FIG. 4C is an underside illustration of the base of FIG. 4 described herein.
Figure 5:
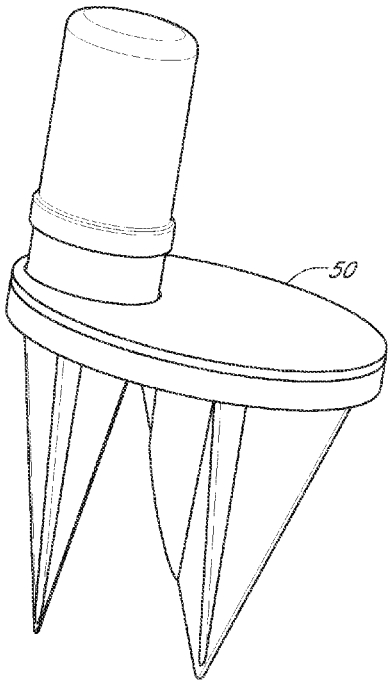
FIG. 5 is a detailed view of a hammer plate and hammer boot for installation of the base of FIG. 4 into the ground.
Figure 5A:
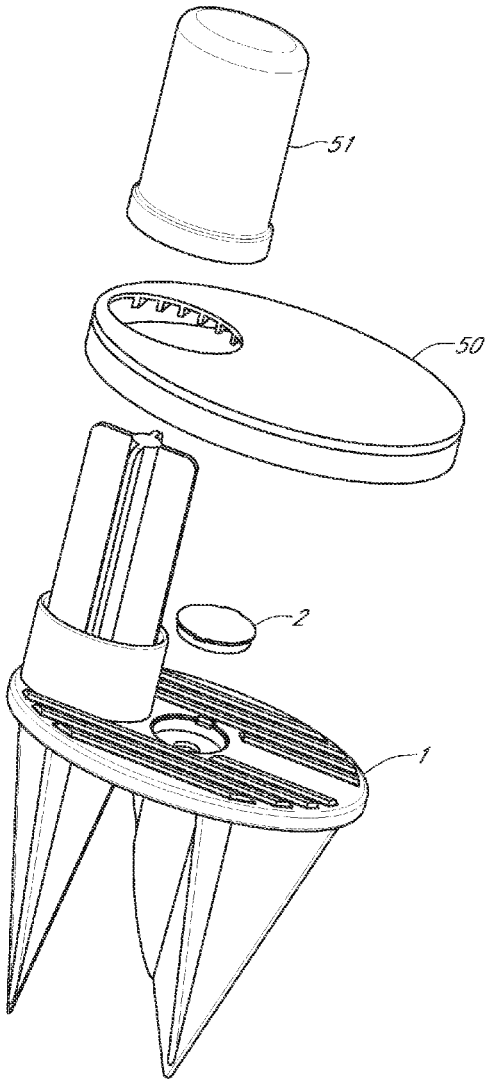
FIG. 5A is an exploded view of the base of FIG. 4 with the hammer boot and hammer plate of FIG. 5 for installation of the base of FIG. 4 into the ground.

The sign post and sign system 100 generally comprises a base 1 having an upper portion 1*a* extending away from the base 1 and a lower portion 1*b* extending away from the base 1. FIG. 4 is a perspective view of the base 1 of one embodiment of the sign post and sign system 10 described herein. FIG. 4A is a side view of the base 1 of FIG. 4 described herein. FIG. 4B is a front view of the base 1 of FIG. 4 described herein. FIG. 4C is an underside illustration of the base of FIG. 4 described herein. The cap 2 positioned in the base top 1*c* allows logo placement. The cap is positioned in aperture 2*a* which may extend down and through the base lower portions 1*b*. As shown, the base lower portions 1*b* are designed to pierce the surface in which in the base 1 is to be set. Additionally, as configured the base 1 further supports placement of the sign post and sign system 100 as the lower portion of the base from aperture 2*a* is configured as a spike guide 2*b* allowing insertion and driving of a ground spike or nail (not shown) for further support of the. Although not shown, it will be apparent to one of ordinary skill that cap 2 covers and protects aperture 2*a* as well as hiding thereby improving the aesthetics of the general design.

Figure 6:
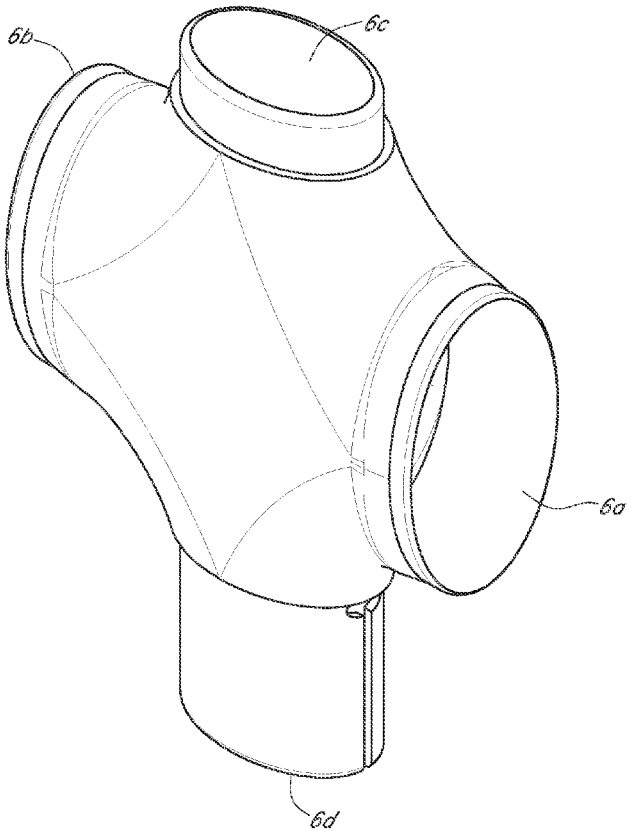
FIG. 6 is a perspective view of the four-way (vertical) connector of one embodiment of the sign post and sign system described herein.
Figure 6A:
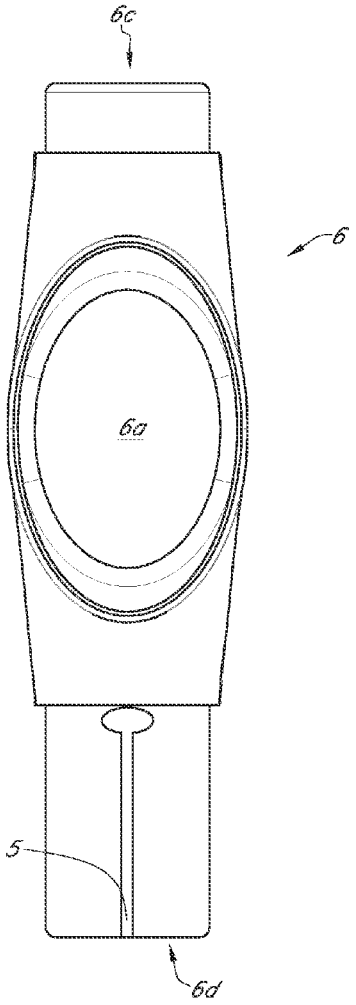
FIG. 6A is a side view of the four way (vertical) connector of FIG. 6 described herein.
Figure 7:
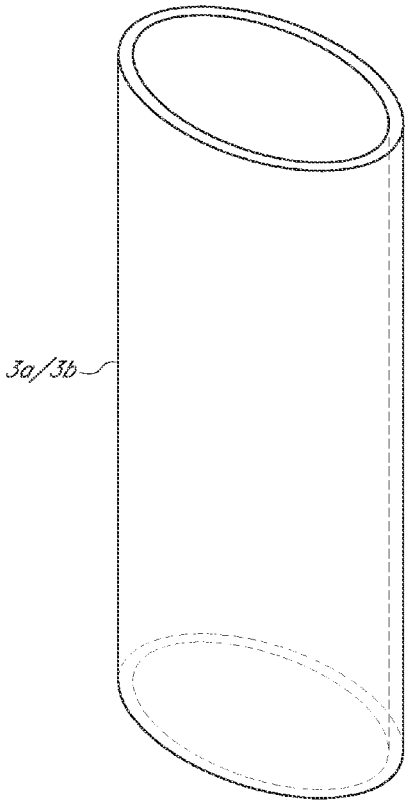
FIG. 7 is a perspective view of the vertical post of one embodiment of the sign post and sign system described herein.
Figure 7A:
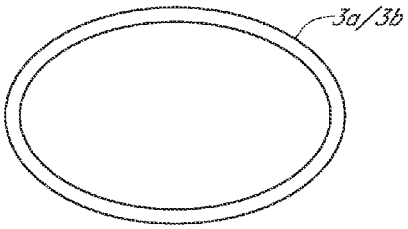
FIG. 7A is an end view of the vertical connector of FIG. 7 described herein.
Figure 9:
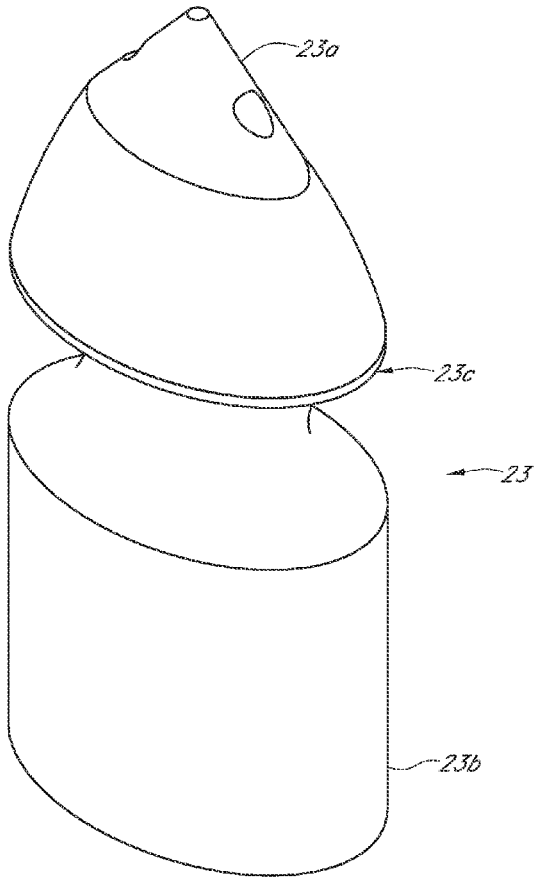
FIG. 9 is a perspective view of a two piece decorative cap for attachment to the vertical connector of FIG. 6.
Figure 9A:
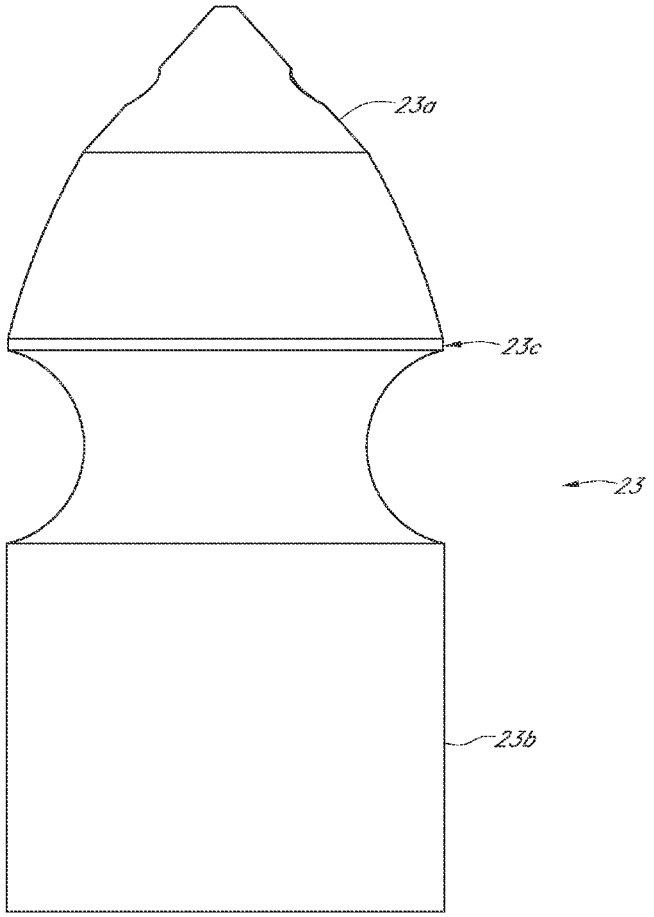
FIG. 9A is a side view of the two piece decorative cap of FIG. 9 described herein.
Figure 9B:
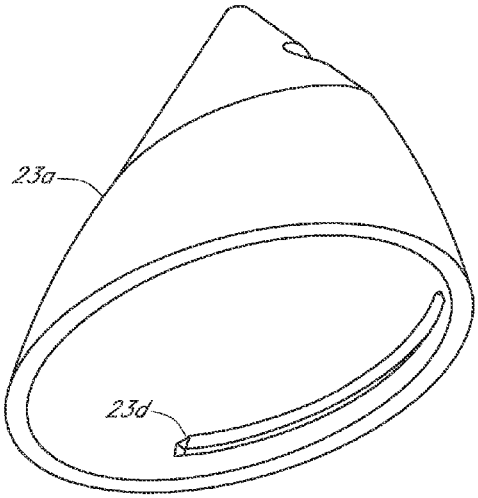
FIG. 9B is a perspective view of the lower end of the top portion of the decorative cap of FIG. 9.
Figure 9C:
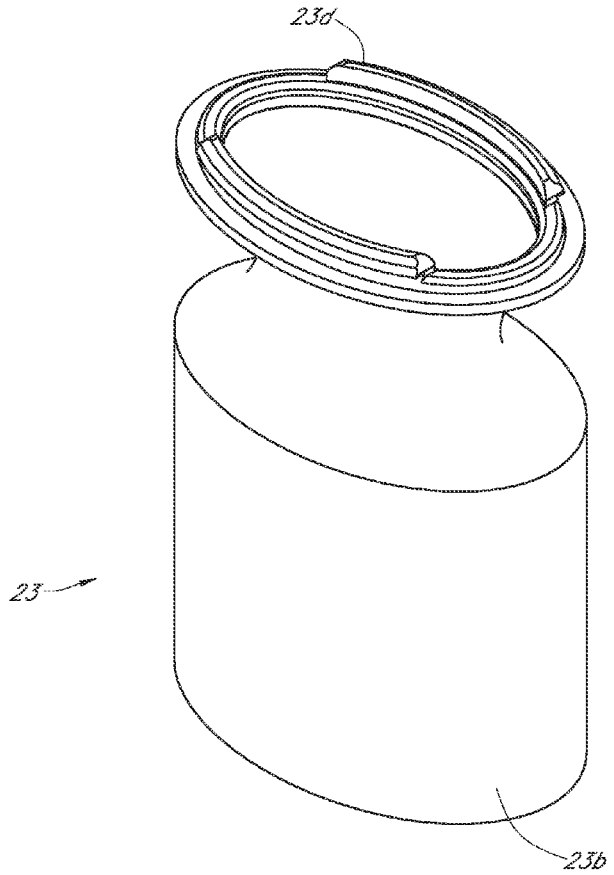
FIG. 9C is a perspective view of the bottom portion of the two piece decorative cap of FIG.
Figure 9D:
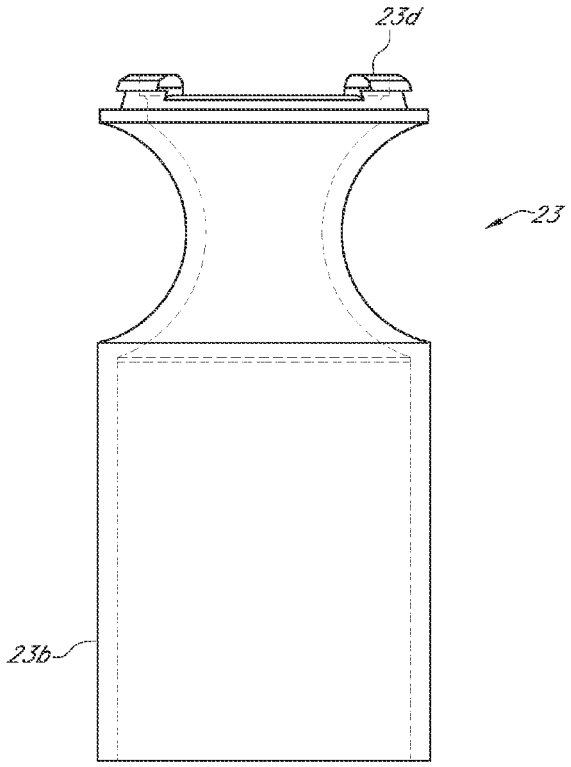
FIG. 9D is a side view of the bottom portion of the piece decorative cap of FIG. 9C described herein.

As shown generally in FIGS. 1, 1A, 2-3 and in detail at FIGS. 7-7A, vertical post 3 is comprised of an upper portion 3*a* having a first end and second end, each of the ends configured with an opening. A lower portion 3*b* having a first end and a second end, with the first end having an opening therein engages with and connects to the upper portion of the base 1*a*. The second end of the lower portion 3*b* is then configured to cooperatively engage with the first end of the upper portion 3*a*. One of ordinary skill will appreciate that the vertical post 3 as shown is hollow, but could be constructed from solid materials and or from a single section or a plurality of sections without departure from the spirit and intent of the present disclosure. The four-way connector 6 attached at the top of the vertical post 3 is configured with both anterior and posterior connection stubs (6*a*, 6*b*). These stubs connect to anterior and posterior horizontal stems (8*a*, 8*b*) upon which a number of fasteners, as discussed in detail further herein, may be attached in support of attaching various signs of various dimensions for both rotation and non-rotation. The four-way connector 6 engages with vertical post 3 via lower connection stub 6*d*. A connector cap 23 may be positioned on an engage with upper connection stub 6*c*. Further detail is provided by FIG. 9 which is a perspective view of a two piece connector cap 23 for attachment to the vertical connector of FIG. 6. FIG. 9A is a side view of the two-piece decorative cap of FIG. 9 described herein. FIG. 9B is a perspective view of the lower end of the top portion of the decorative cap 23*a* of FIG. 9. As shown in FIG. 9B, locking ridges 23*d* may be placed in the interior of the upper portion 23*a* for engagement with the lower portion 23*b* to form interface 23*c*. One of ordinary skill will appreciate the configuration may be reversed and that threads may be used instead of locking ridges. FIG. 9C is a perspective view of the bottom portion 23*b* of the two piece decorative cap. FIG. 9D is a side view of the bottom portion of the piece decorative cap of FIG. 9C. One of ordinary skill will appreciate that the upper connection stub 6*c* may be configured as a non-removable cap without departure from the spirit and intent of the present disclosure. As disclosed, the general design of the sign post and sign system 100 is meant to be modular and allow for various configurations, re-use in various applications and replacement of parts, as needed from time to time due to vandalism, weather and general wear. By way of way illustration and without restriction, rider pins are replaceable with rider clips or spinning rider clips and/or spinning rider pins, for example in the various sign positions shown in the FIGS.

Figure 10A:
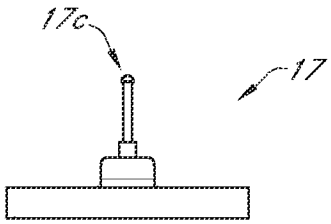
FIG. 10A is a side view of the bottom spinner support of FIG. 10 described herein.
Figure 10:
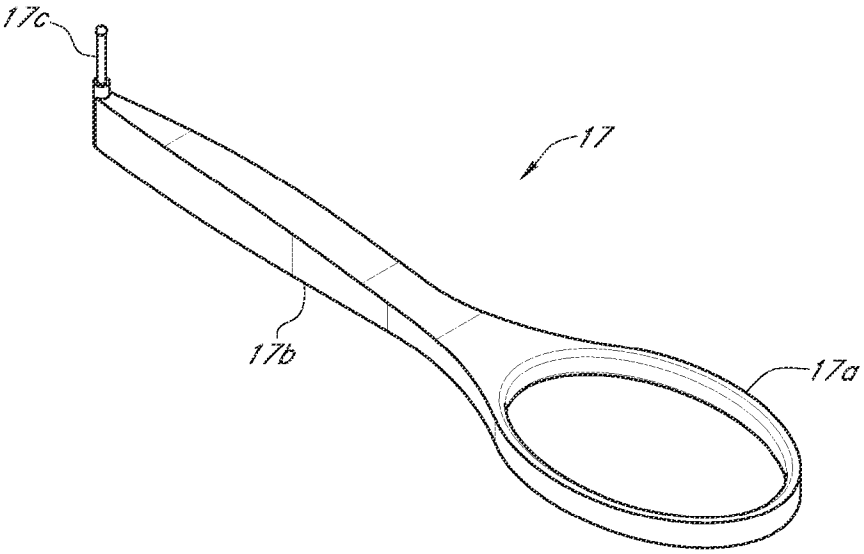
FIG. 10 is a perspective view of the bottom spinner support.
Figure 11:
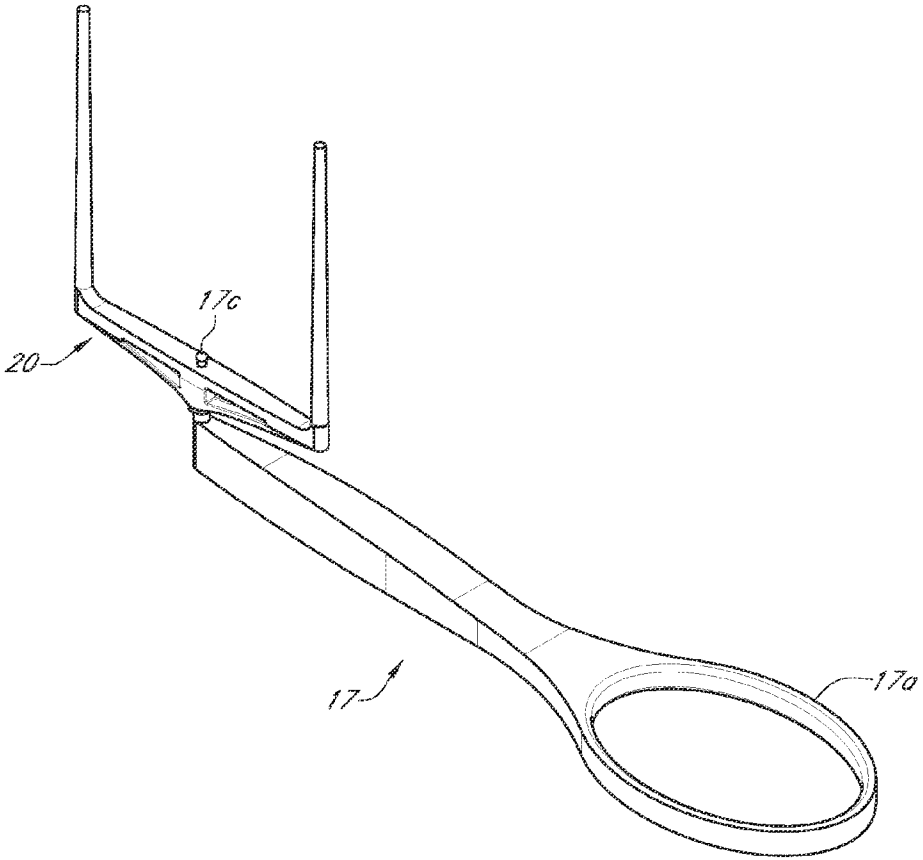
FIG. 11 is a perspective view of the bottom spinner support of FIG. 10 configured with a spinner with a two-pin end configured in a u-shape.
Figure 11A:
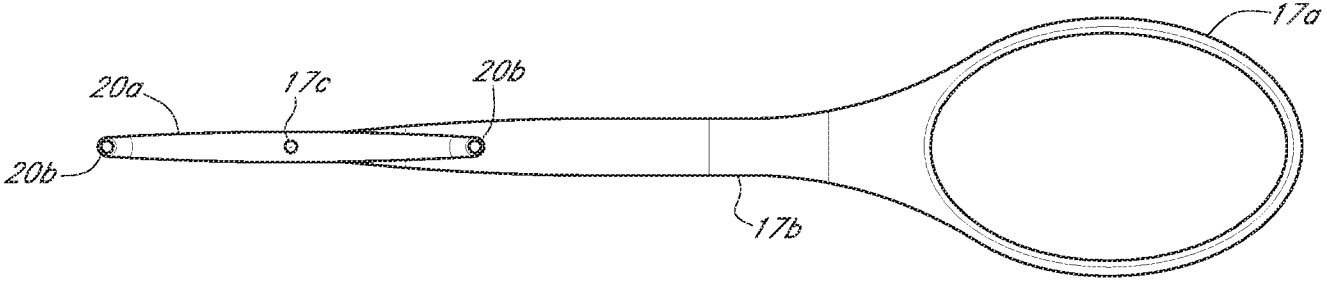
FIG. 11A is a top view of the bottom spinner support of FIG. 11 described herein.
Figure 12:
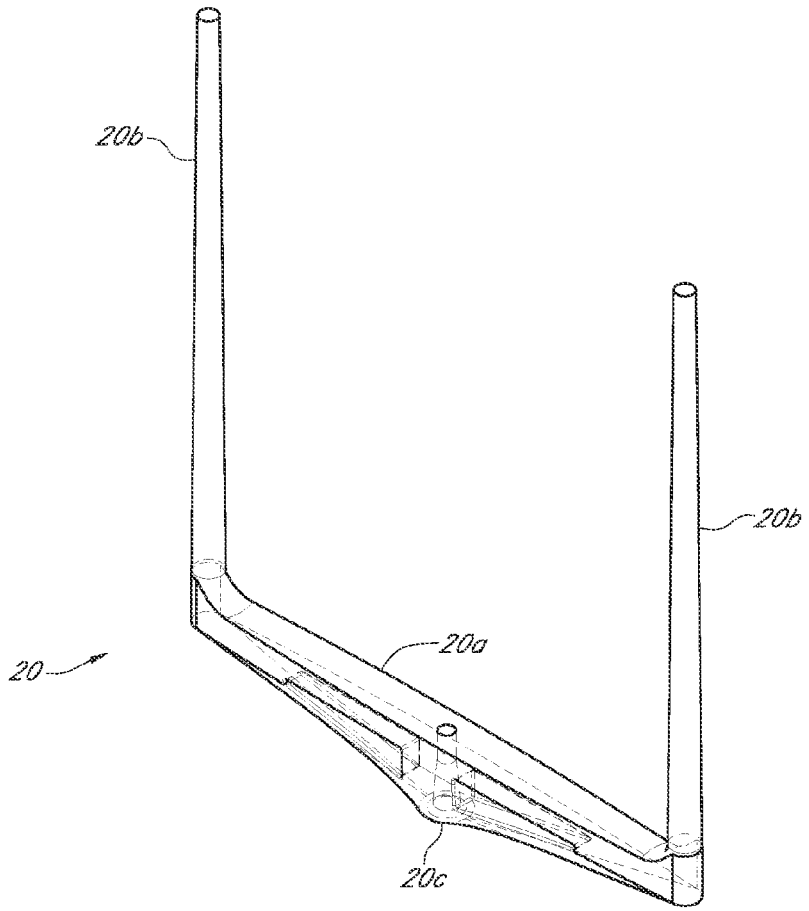
FIG. 12 is a detailed perspective view of the spinner of FIG. 11 configured as a two-pin end.
Figure 12A:
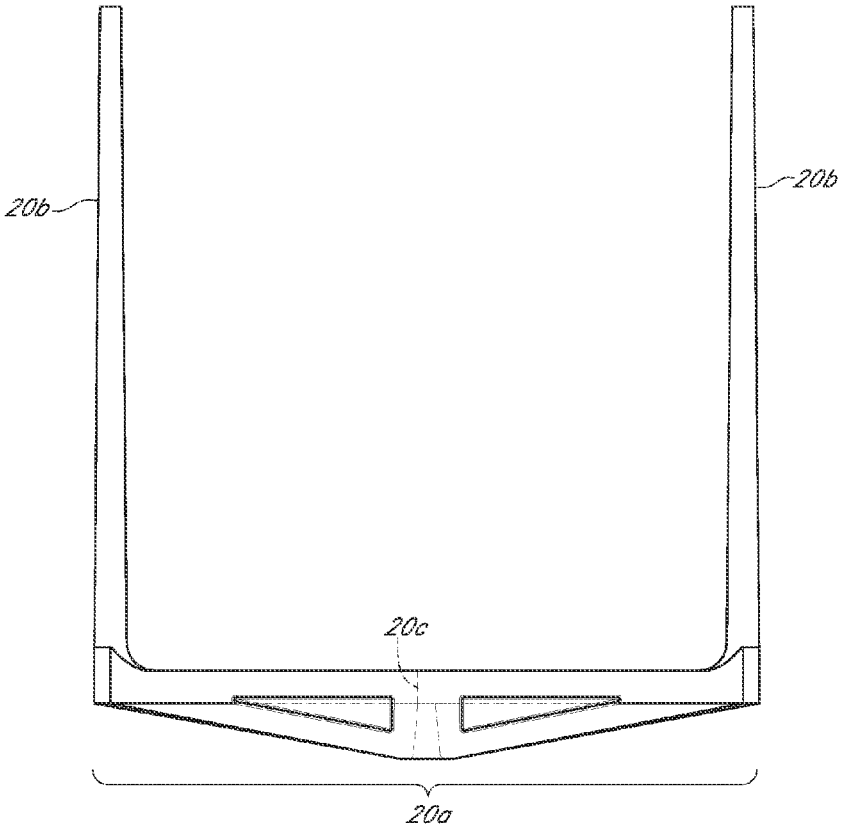
FIG. 12A is a front view of the spinner configured with as a two-pin end of FIG. 12.
Figure 13:
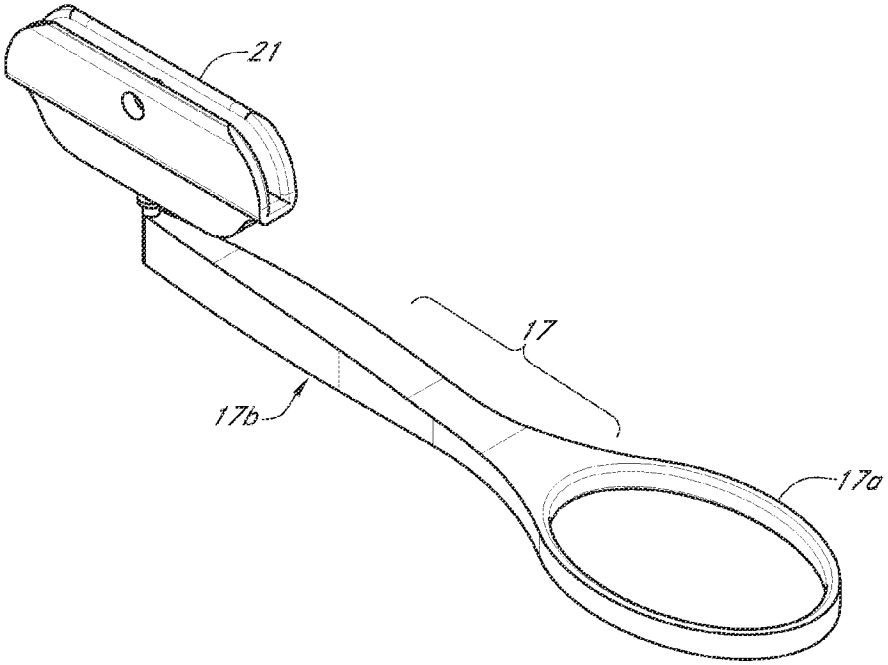
FIG. 13 is a detailed perspective view of another embodiment of the bottom spinner of FIG. 12 configured with a clip end.

The bottom spinner support 17 is attached to the vertical post 3 and as shown generally in FIGS. 1, 1A, 2-3 and in detail at FIGS. 10, 11 and 13, provides a fixed base or support that allows for various configurations of rotatable fasteners including without limitation the spinner 20 (pin configuration) and spinner clip 21. As shown, the bottom spinner support 17 has a first end configured as a vertical post receiver 17*a* for attachment to the vertical post 3 (or vertical connector 4) connecting a second end configured with a shaft 17*c* by arm 17*b* to support and engage with the rotatable fastener. As shown in FIGS. 11 and 12, spinner 20 is comprised as a base

20*a* having a pair of pins 20*b* positioned on either end of the base 20*a* with a receiver (bore) 20*c* positioned proximate the center of the base 20*a*. The spinner 20 is engaged with shaft 17*c* and rotates freely around 17*c*. An additional fastener, such as shaft cap, may be used to hold spinner 20 on shaft 17*c* (not shown) and a washer 19 (not shown) may be positioned between base 20*a* and arm 17*b*, without departure from the spirit and intent of the present disclosure. Pins 20*b* may be directly inserted into a sign made of corrugated cardboard (not shown) without need for additional means of securement.

Figure 13A:
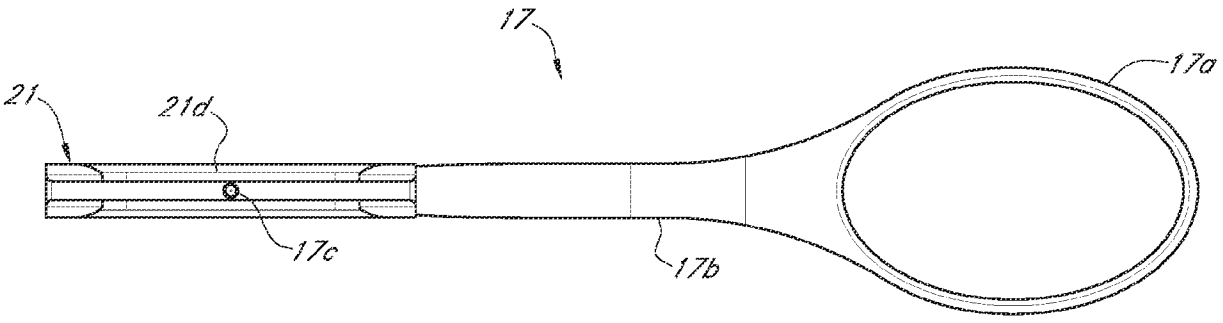
FIG. 13A is a top view of the bottom spinner of FIG. 13 configured with a clip end.
Figure 14A:
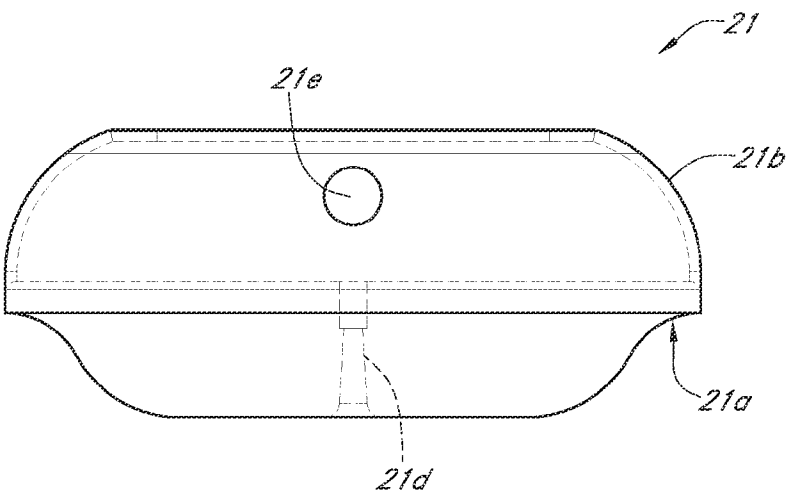
FIG. 14A is a side view of the clip end of FIG. 14.
Figure 14:
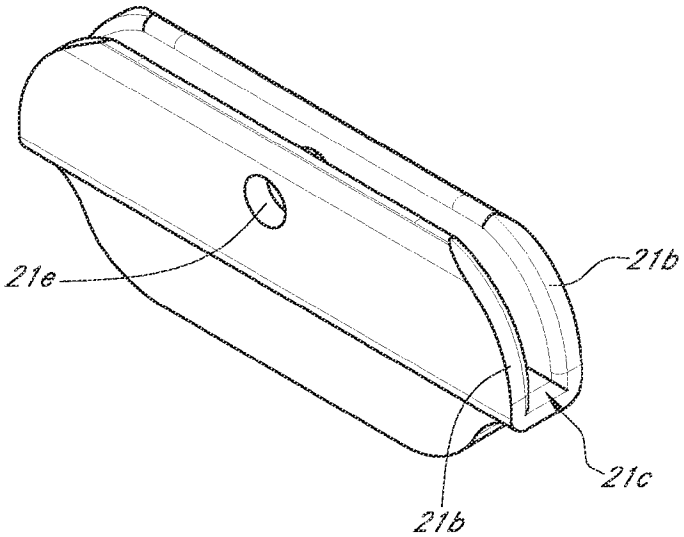
FIG. 14 is a detailed perspective view of the clip end shown in FIGS. 13 and 13A.
Figure 15A:
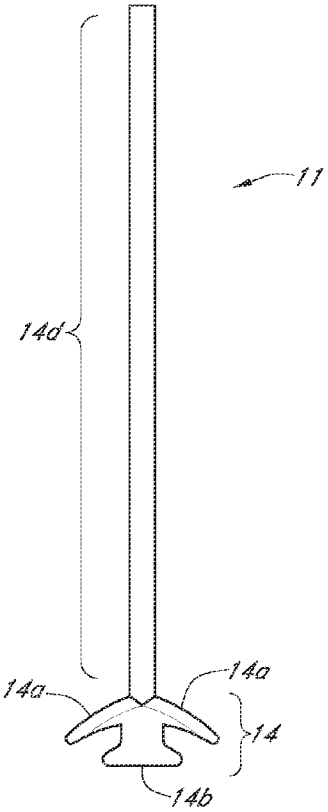
FIG. 15A provides a detailed side view of the rider pin of FIG. 15.
Figure 15:
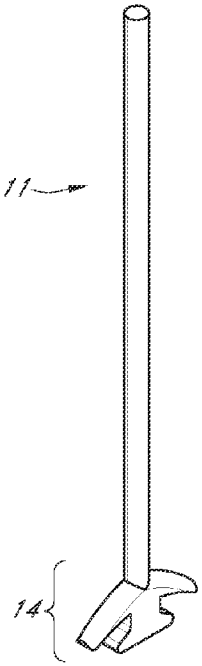
FIG. 15 is a detailed perspective view of a rider pin configured as a rail base and pin end.
Figure 15B:
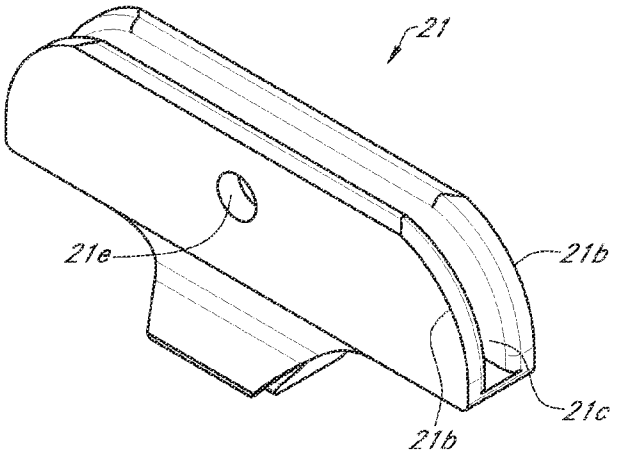
FIG. 15B provides a perspective view of the rider pin of FIG. 15 configured with a clip end which does not rotate in this configuration.
Figure 15C:
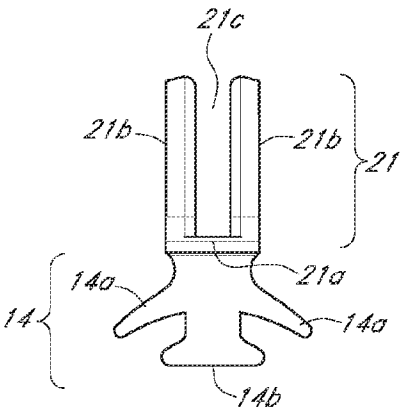
FIG. 15C provides a perspective view of the rider pin of FIG. 15 configured with a clip end which does not rotate in this configuration.
Figure 15D:
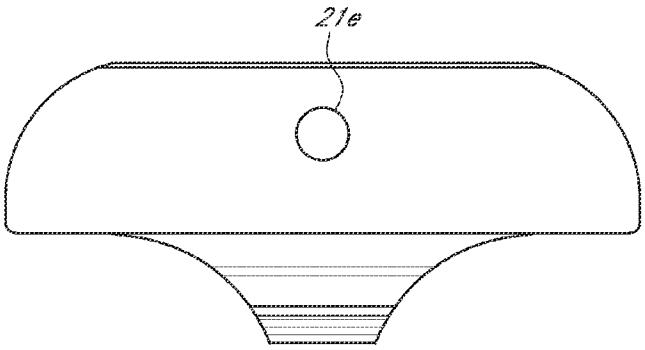
FIG. 15D provides a side view of rider pin configured with a clip end of FIG. 15B and FIG. 15C.

FIG. 13 is a detailed perspective view of another embodiment of the bottom spinner support 17 of FIG. 12 configured with a clip end 21. FIG. 13A is a top view of the bottom spinner support 17 of FIG. 13 configured with a clip end 21. FIG. 14 is a detailed perspective view of the clip end 21 shown in FIGS. 13 and 13A. The spinner clip 21 functions similar to the spinner 20, the spinner clip 21 is engaged with shaft 17*c* at receiver (bore) 21*d* and rotates freely around shaft 17*c*. An additional fastener, such as a shaft cap, may be used to hold spinner 20 on shaft 17*c* (not shown) and a washer 19 (not shown) may be positioned between base 21*a* and arm 17*b*, without departure from the spirit and intent of the present disclosure. As illustrated in FIGS. 14 and 14A, the spinner clip 21 is configured to engage and surround the end of a sign between sidewalls 21*b* in engagement area 21*c*. (See FIGS. 1 and 1A) Aperture 21*e* positioned in the upper portion of sidewalls 21*b* allows insertion of a rivet, bolt or other fastener to further secure the edge of the sign, if needed. As should be clear, use of spinner 20 or spinner clip 21 allows placement of a sign in position 4 to rotate about its y-axis, next to the vertical post 3. As one of ordinary skill will appreciate, based on the present disclosure, non-rotational fasteners may also be used or swapped out, allowing for the elimination of rotation of the sign placed in position 4.

Figure 8:
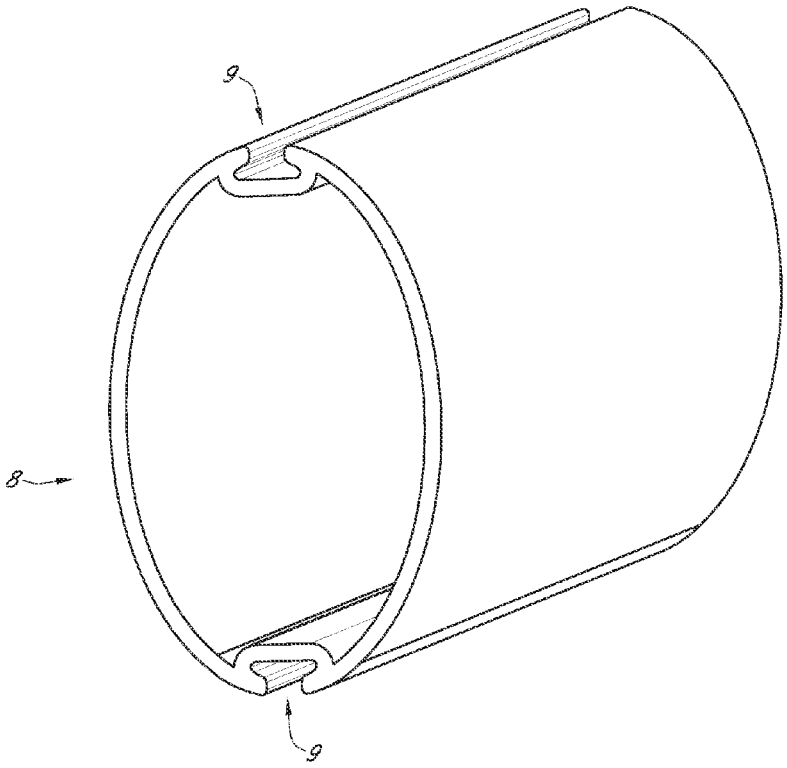
FIG. 8 is a perspective view of the horizontal stem of one embodiment of the sign post and sign system described herein.
Figure 8A:
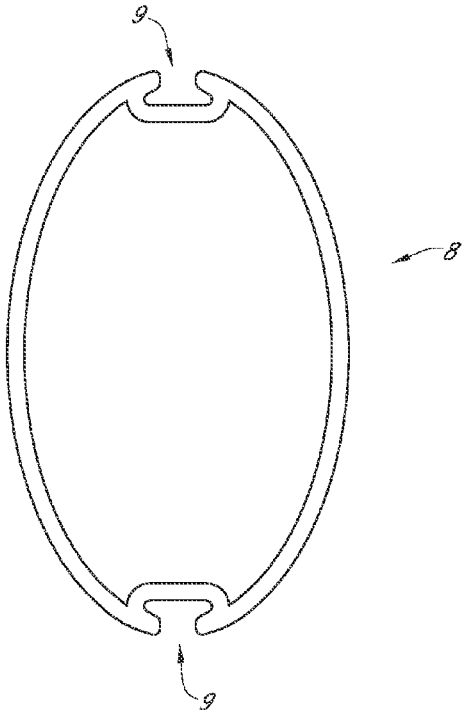
FIG. 8A is an end view of the horizontal stem of FIG. 8 described herein.

As shown, the horizontal stem 8 may be configured with multiple configurations of fasteners—both rotational and non-rotational, as well as multiple types of apertures. FIG. 8 is a perspective view of the horizontal stem 8 of one embodiment of the sign post and sign system 100 described herein and illustrates the inclusion of channels 9 therein. See also FIG. 8A is an end view of the horizontal stem of FIG. 8 described herein. The hooks 10 having a rail attachment end 14, may be used with the channel 9 shown in FIGS. 8 and 8A for attachment of the end of a sign. FIG. 8 is a perspective view of the horizontal stem of one embodiment of the sign post and sign system described herein. FIG. 8A is an end view of the horizontal stem of FIG. 8 described herein. As disclosed herein, sign hook 10, rider pin (non-rotatable) 11 and rider clip 21 with rail attachment end 14 (see FIGS. 15A-15D) are non-rotational fasteners that may be used with present sign post and sign system 100. Additionally, rotating and non-rotating signs may be attached at positions 1, 2 and 3 as shown at least in FIGS. 1, 1A (30, 31, 32, respectively).

Figure 16A:
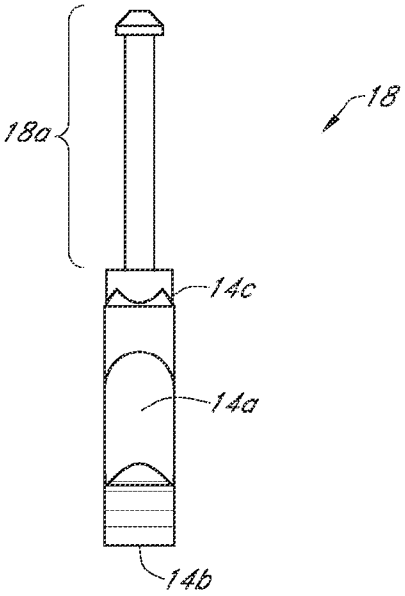
FIG. 16A provides a detailed side view of the rider pin of FIG. 16.
Figure 16:
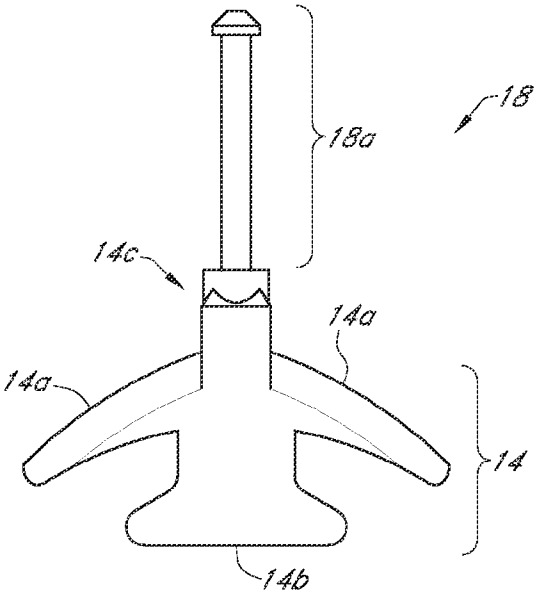
FIG. 16 is a detailed front view of a spinner rider pin 18 configured with a rail base 14 and shaft end 18*a* allowing rotation of a sign engaged therein as illustrated by FIGS. 1 and 2.
Figure 17:
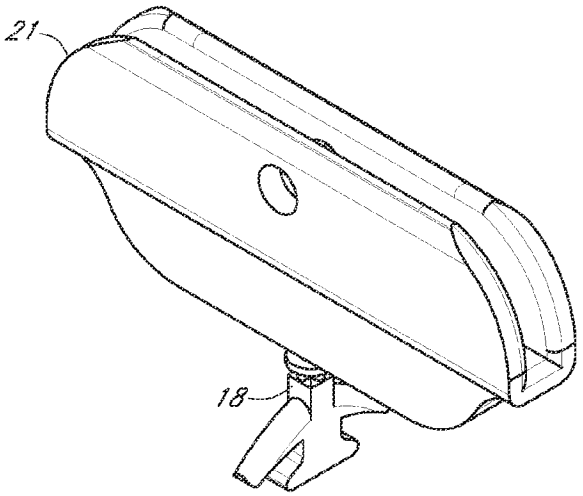
FIG. 17 provides a perspective view of another embodiment of the spinner rider pin 18 of FIG. 16 which allows rotation of the clip assembly engaged with its shaft therein.

FIG. 16A provides a detailed side view of the rider pin of FIG. 16. FIG. 17 provides a perspective view of another embodiment of the spinner rider pin 18 of FIG. 16 which allows rotation of the clip assembly engaged with its shaft therein.

Figure 17B:
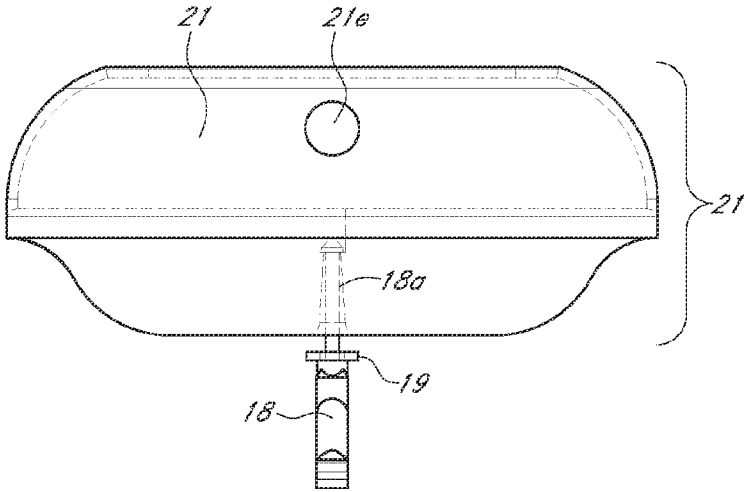
FIG. 17B provides a side view of spinner rider pin configured with a clip end as illustrated in FIGS. 17 and 17A.
Figure 17A:
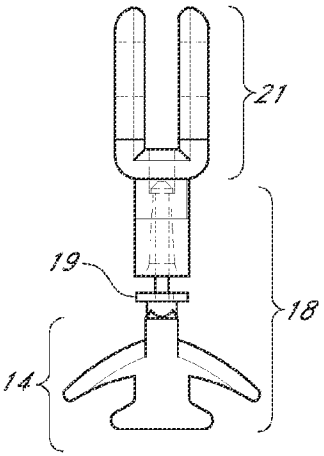
FIG. 17A provides front view of the spinner rider pin of FIG. 16 configured with a clip end which may rotate in this configuration.
Figure 18:
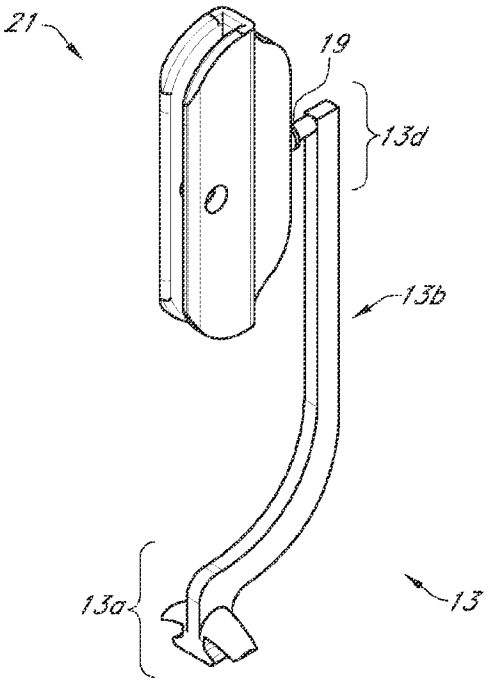
FIG. 18 is a detailed perspective view of another configuration of a spinner rider pin 13 configured with a rail base and a clip end for insertion of the rail base into the channel of the horizontal stem.
Figure 18B:
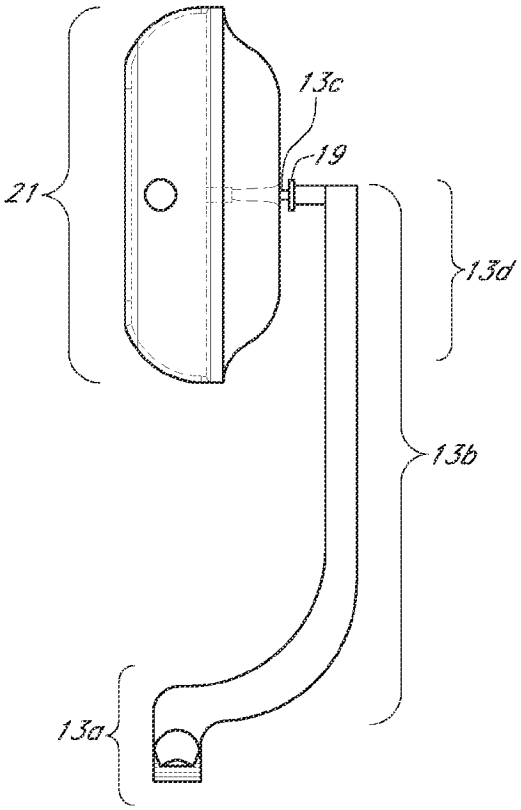
FIG. 18B provides a detailed side view of the spinner rider pin 13 of FIGS. 18 and 18A.
Figure 18A:
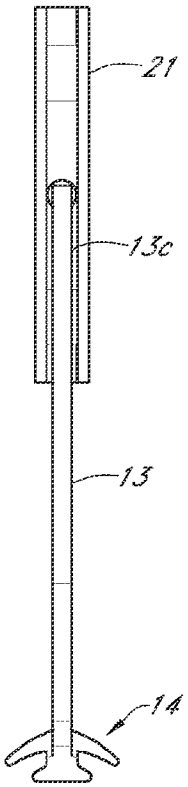
FIG. 18A provides a detailed front view of the spinner rider pin 13 having a rail end at its first end 18*a* and a spinner clip 21 attached to its arm 13*b* extending from the shaft 13*c* located at its second end 13*d*.
Figure 19:
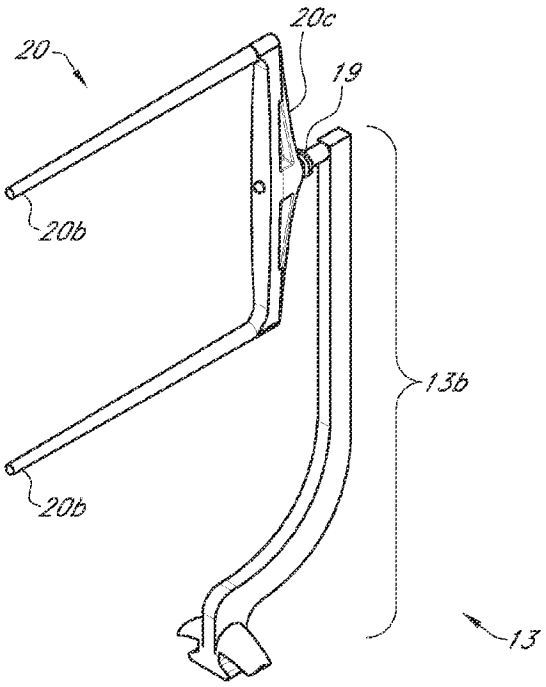
FIG. 19 is a detailed perspective view of a spinner rider pin 13 configured with a rail base for insertion into the channel of the horizontal stem and a rotatable spinner with duel pins attached at its other end.
Figure 19B:
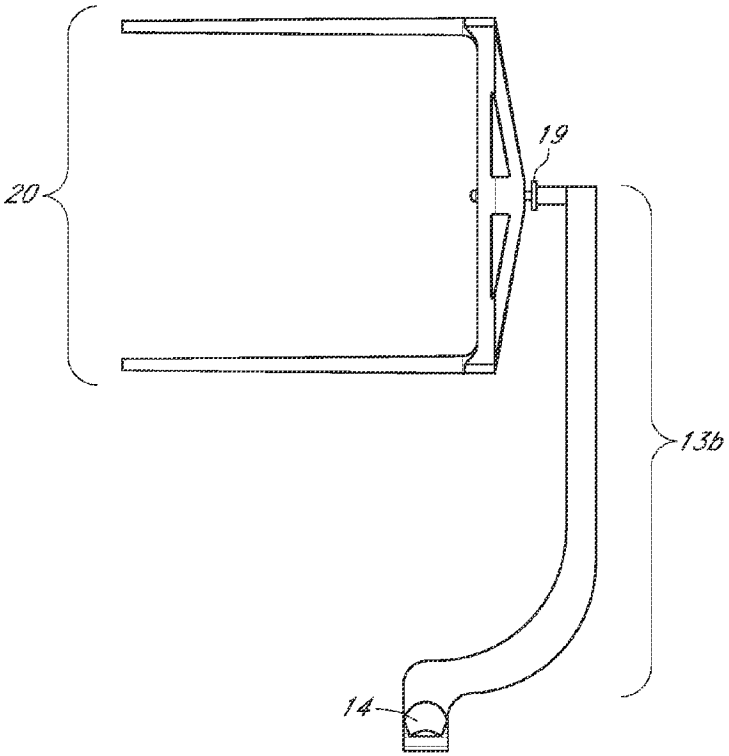
FIG. 19B provides a detailed side view of the spinner rider pin 13 of FIGS. 19 and 19A.
Figure 19A:
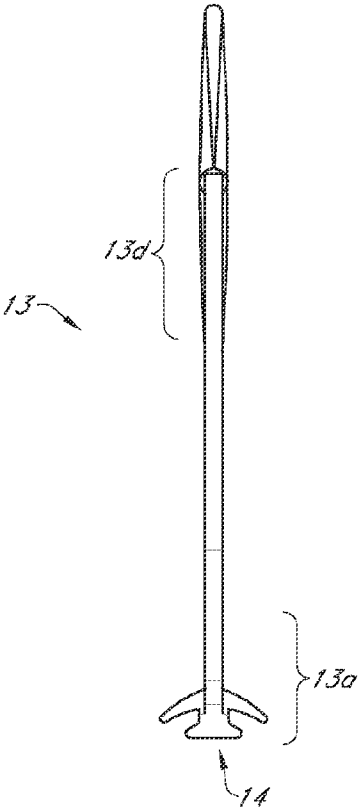
FIG. 19A provides a detailed front view of the spinner rider pin 13 having a rail end at its first end 18*a* and a duel pin spinner 20 attached to its arm 13*b* extending from the shaft 13*c* located at its second end 13*d*.
Figure 20:
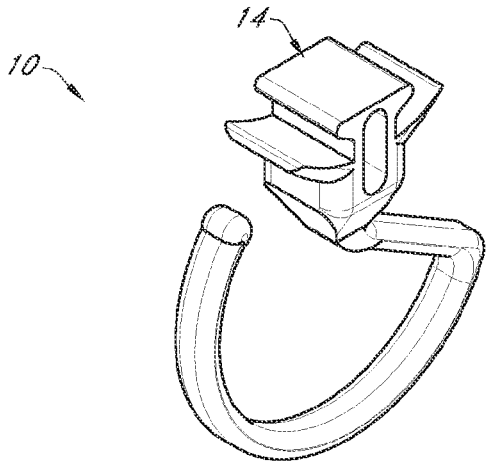
FIG. 20 is a detailed perspective view of a sign hook 10 configured with a rail base 14 for insertion into the channel 9 of the horizontal stem configured with a non-rotatable hook attached at its other end.
Figure 20A:
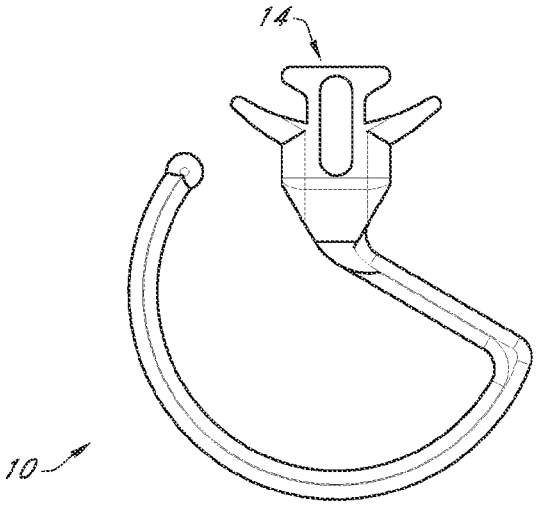
FIG. 20A provides a detailed side view of the sign hook of FIG. 20.

FIG. 17A provides front view of the spinner rider pin of FIG. 16 configured with a clip end which may rotate in this configuration. FIG. 17B provides a side view of spinner rider pin configured with a clip end as illustrated in FIGS. 17 and 17A. FIG. 18 is a detailed perspective view of another configuration of a spinner rider pin 13 configured with a rail base and a clip end for insertion of the rail base into the channel of the horizontal stem. FIG. 18A provides a detailed front view of the spinner rider pin 13 having a rail end at its first end 18*a* and a spinner clip 21 attached to its arm 13*b* extending from the shaft 13*c* located at its second end 13*d*. FIG. 18B provides a detailed side view of the spinner rider pin 13 of FIGS. 18 and 18A. FIG. 19 is a detailed perspective view of a spinner rider pin 13 configured with a rail base for insertion into the channel of the horizontal stem and a rotatable spinner with duel pins attached at its other end. FIG. 19A provides a detailed front view of the spinner rider pin 13 having a rail end at its first end 18*a* and a duel pin spinner 20 attached to its arm 13*b* extending from the shaft 13*c* located at its second end 13*d*. FIG. 19B provides a detailed side view of the spinner rider pin 13 of FIGS. 19 and 19A. FIG. 20 is a detailed perspective view of a sign hook 10 configured with a rail base 14 for insertion into the channel 9 of the horizontal stem configured with a non-rotatable hook attached at its other end. FIG. 20A provides a detailed side view of the sign hook of FIG. 20. Further, one of ordinary skill will appreciate that other means of attachment or fastening, may be used that require placement in either the horizontal or vertical components disclosed herein, that allow for non-rotation or rotation, as required by the particular application without departure from the spirit and intent of the present disclosure.

Figure 21:
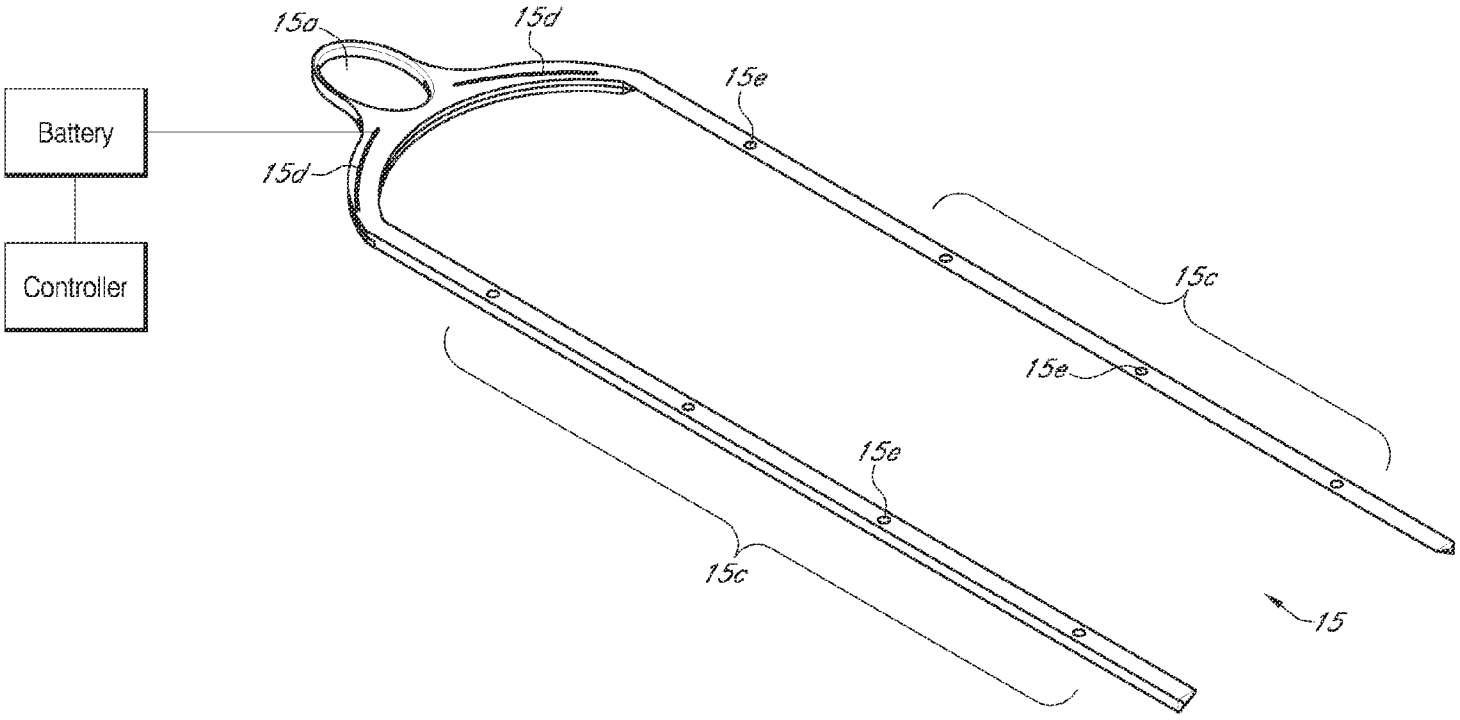
FIG. 21 is a detailed perspective view of one embodiment of a light fork 15 configured for use with the vertical post of the present disclosure for illumination of signs attached therein.
Figure 22:
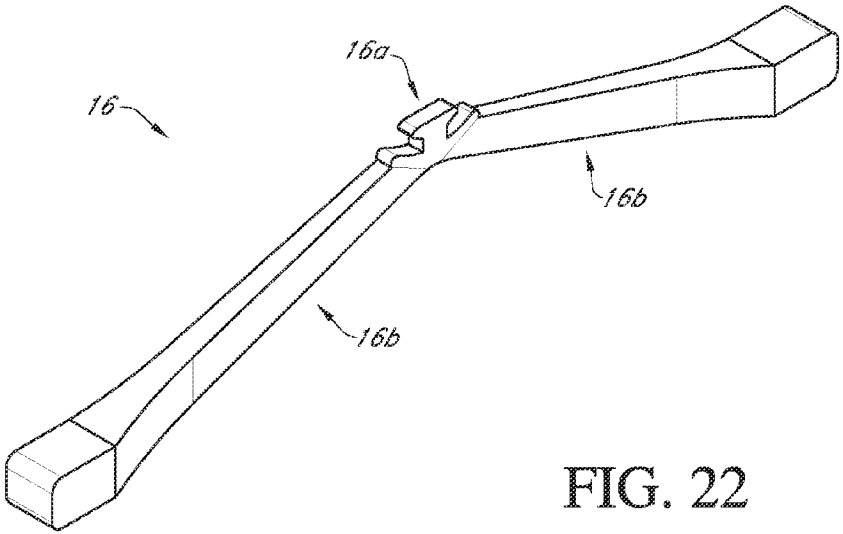
FIG. 22 provides a detailed front perspective view of the light fork rail stabilizer 16 for use with the light fork rail of FIG. 21.
Figure 22A:
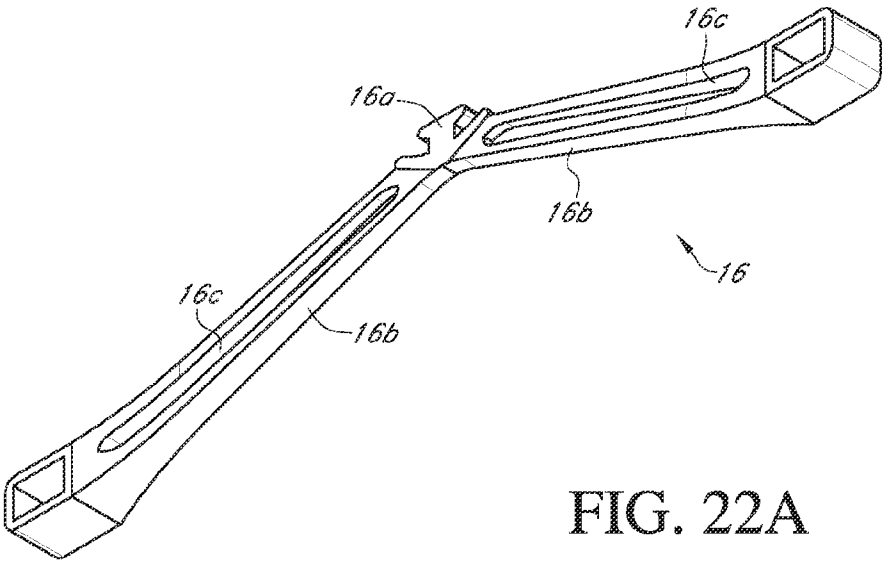
FIG. 22A provides a detailed rear perspective view of the light fork rail stabilizer 16 for use with the light fork rail of FIG. 21.

FIG. 21 is a detailed perspective view of another one embodiment of the present disclosure which is a light fork rail 15 configured for use with the vertical post 3 of the present disclosure for illumination of signs attached therein. FIG. 21 provides a detailed side view of the light fork rail 15 of FIG. 21. As configured, the light fork rail 15 is integrated with LEDS 15*e* positioned in the arms 15*c* of the light fork rail 15, and are electrically connected via channels 15*d*, positioned internal to the arms 15*c*, to a power source such as a battery which may be positioned internal the vertical post 3 or horizontal stem 8 or the connector cap 23, dependent on the particular application. Optionally, a control system and or timer system may also be connected to the lights, dependent on the particular application. A solar collector (not shown) may be configured and electrically connected as well to provide a power source for the lighting source therein. As shown in FIG. 22, the light fork rail 15 may be installed with a light fork rail stabilizer 16 on the end opposite the vertical post 3 for use with the light fork rail 15 of FIG. 21 for improved securement. FIG. 22A provides a detailed rear perspective view of the light fork rail stabilizer 16 for use with the light fork rail 15 of FIG. 21, particularly the light fork legs 16*b* and channels 16*c* which accept and engage with the light fork rail arms 15*c*.

Figure 23:
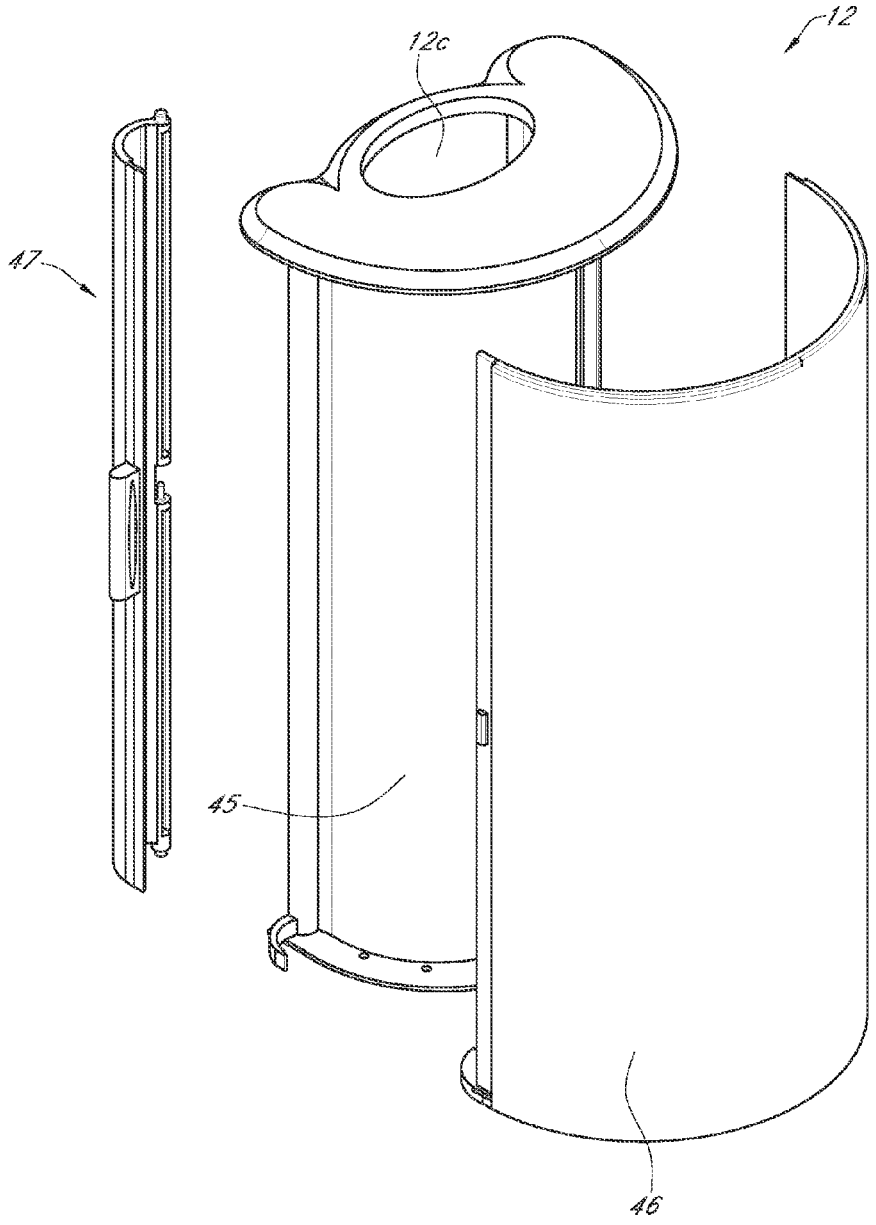
FIG. 23 provides a detailed front perspective exploded view of one embodiment of the flyer box assembly for attachment to the vertical connector and use with the sign and sign post system disclosed herein.

FIG. 23 provides a detailed front perspective exploded view of one embodiment of the flyer box assembly 12 for attachment to the vertical connector 4 and use with the sign and sign post system 100 disclosed herein.

Figure 23A:
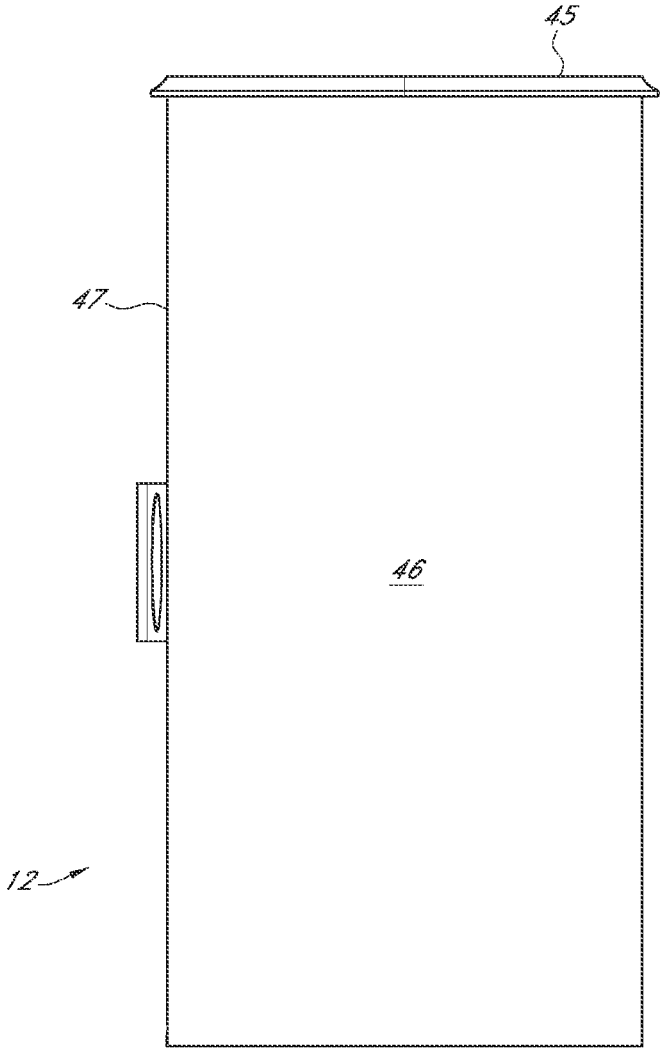
FIG. 23A provides a perspective view of the flyer box assembly 12 of FIG. 23 which is configured to engage with and fit around the vertical connector portion of the sign post and is accessible via a flyer door 47 positioned in the back of the flyer box 45.

FIG. 23A provides a perspective view of the flyer box assembly 12 of FIG. 23 which is configured to engage with and fit around the vertical connector 4 portion of the sign post and is accessible via a flyer door 47 positioned in the back of the flyer box 45. FIG. 23A is a front view of the flyer box assembly of FIG. 23.

Figure 23B:
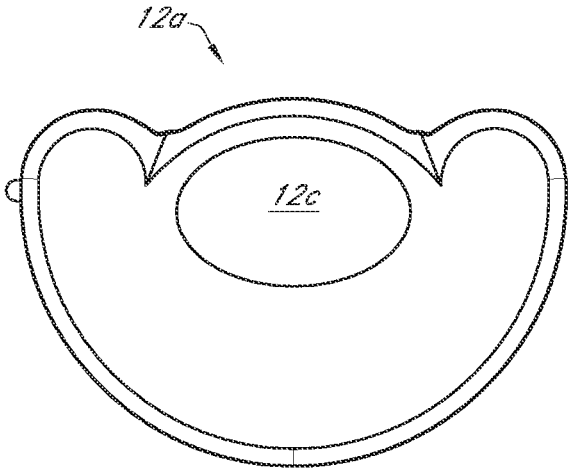
FIG. 23B is a view of the top 12*a* of the flyer box assembly of FIG. 23.
Figure 23C:
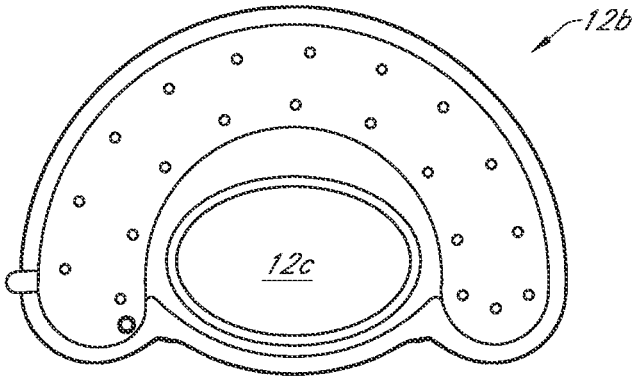
FIG. 23C is a view of the bottom 12*b* of the flyer box assembly of FIG. 23.
Figure 24:
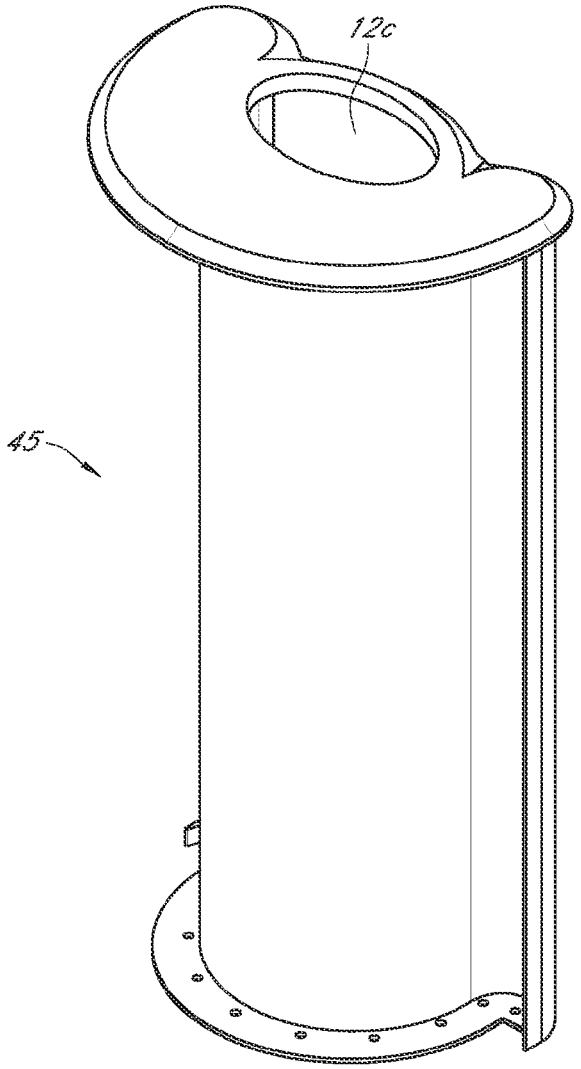
FIG. 24 provides a detailed front perspective view of the flyer box of FIG. 23 for use with the sign and sign post system disclosed herein.

FIG. 23B is a view of the top 12*a* of the flyer box assembly of FIG. 23. FIG. 23C is a view of the bottom 12*b* of the flyer box assembly of FIG. 23. FIG. 24 provides a detailed front perspective view of the flyer box of FIG. 23 for use with the sign and sign post system disclosed herein.

Figure 24A:
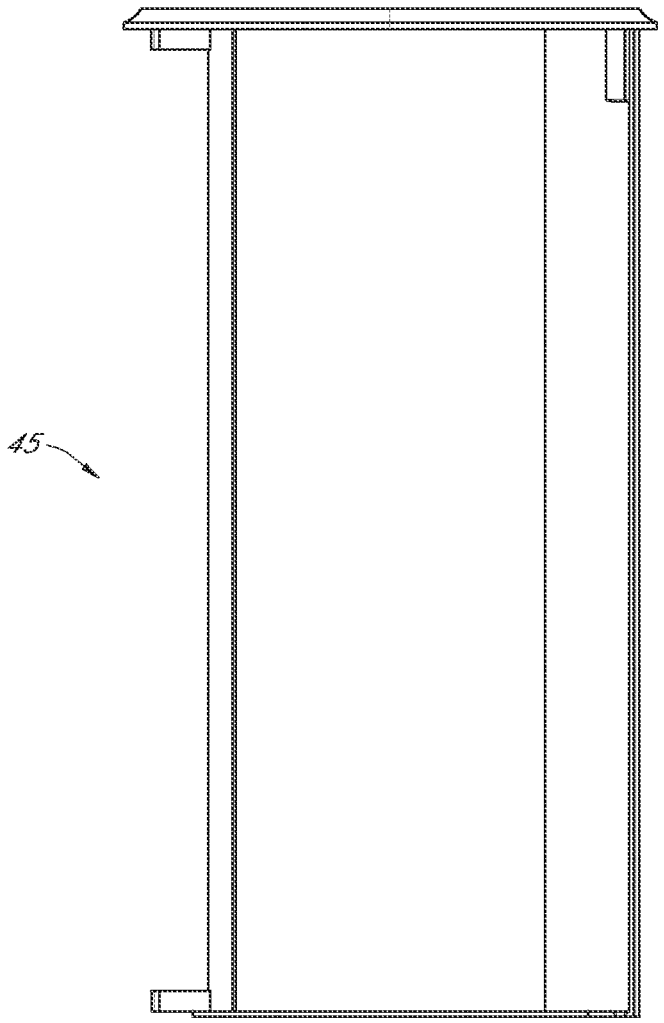
FIG. 24A is a front view of the flyer box back 45 of FIG. 24.

FIG. 24A is a front view of the flyer box back 45 of FIG. 24.

Figure 24B:
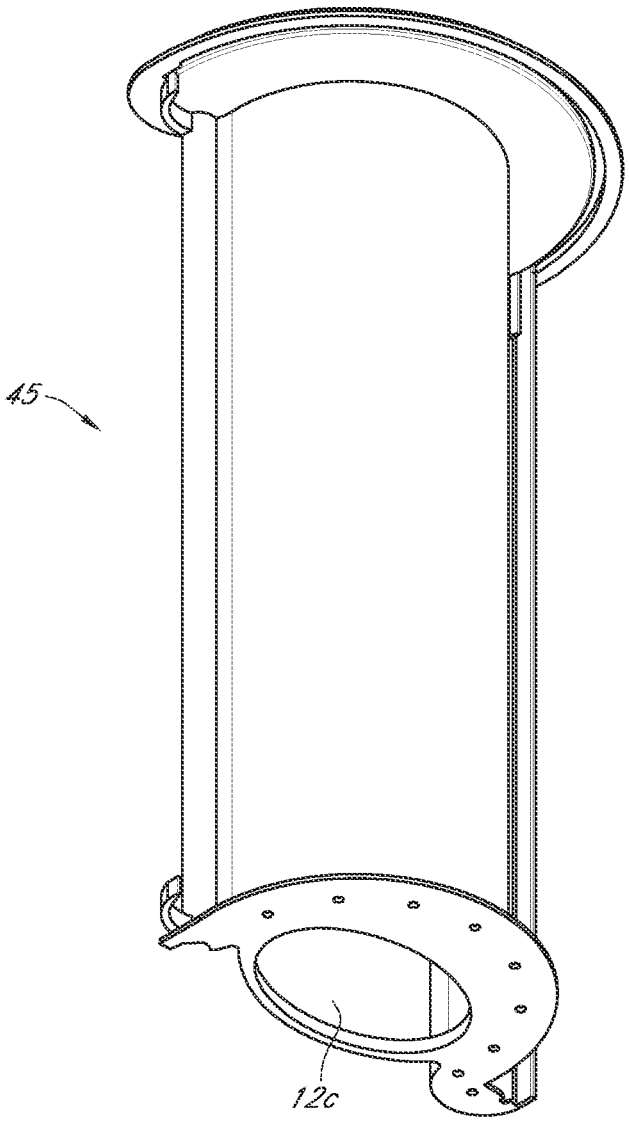
FIG. 24B is an underside perspective view of the flyer back box 45 of FIG. 24.

FIG. 24B is an underside perspective view of the flyer back box 45 of FIG. 24.

Figure 25:
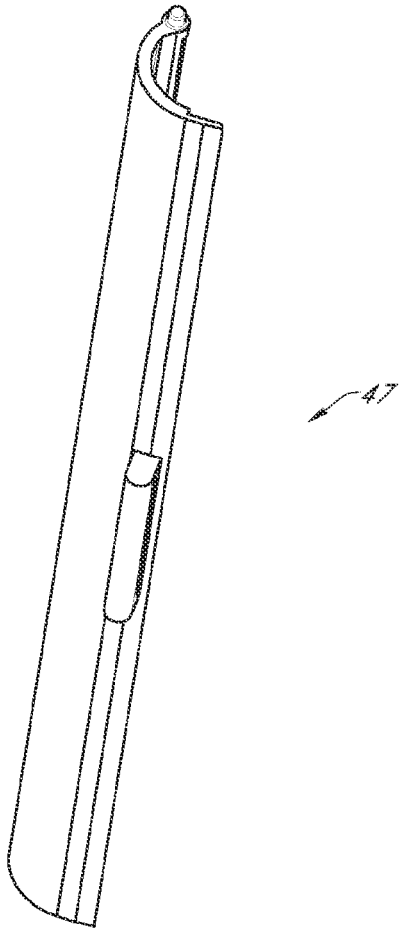
FIG. 25 provides a detailed front perspective view of the flyer box door of FIG. 23 for use with the sign and sign post system disclosed herein.

FIG. 25 provides a detailed front perspective view of the flyer box door of FIG. 23 for use with the sign and sign post system disclosed herein.

Figure 25A:
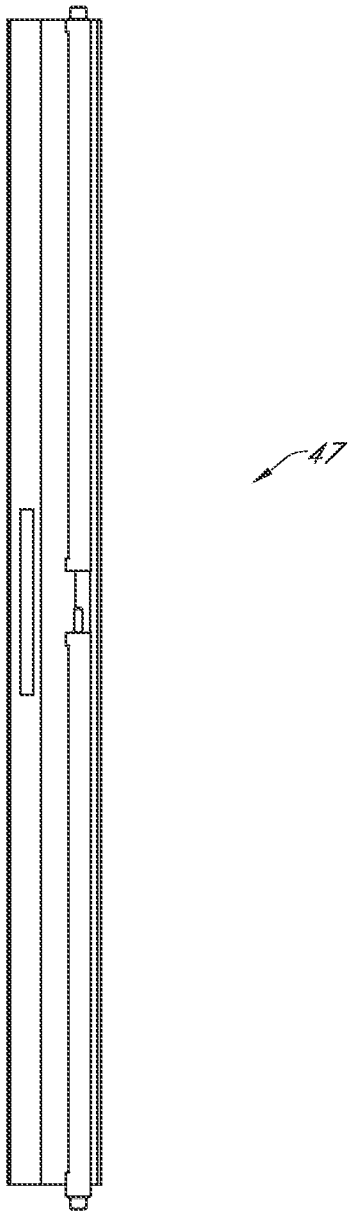
FIG. 25A is a side view of the flyer box door of FIG. 25.

FIG. 25A is a side view of the flyer box door of FIG. 25.

Although only exemplary embodiments of the invention have been described in detail above, those skilled in the art will readily appreciate that many modifications are possible without materially departing from the novel teachings and advantages of this invention. Accordingly, all such modifications are intended to be included within the scope of this invention as defined in the following claims.

What is claimed is:

1. A sign post and sign system comprising:

a) A base (1), the base (1) having an upper portion (1*a*) extending away from the base (1) and a lower portion (1*b*) extending away from the base (1);

b) A vertical post (3) further comprising:

i) An upper portion (3*a*) having a first end and second end, each of the ends configured with an opening;

ii) A lower portion (3*b*) having a first end and a second end, the first end configured with an opening for engagement and connection with the upper portion of the base 1*a* and the second end configured to cooperatively engage with the first end of the upper portion (3*a*);

c) A four-way connector (6) further comprising:

i) A lower connection stub (6*d*) configured to engage with and rest upon the second end of the upper portion (3*b*) of the vertical post (3);

ii) An anterior connection stub (6*a*) configured to engage with and connect to an anterior stem (8*a*);

iii) A posterior connection stub (6*b*) configured to engage with and connect to the second posterior stem (8*b*), wherein a rotatable fastener is cooperatively engaged with a lower side of the posterior connection stub (6*a*);

iv) An upper connection stub (6*c*) configured to engage with and connect to a connector cap (23);

d) A bottom spinner support (17) comprising a bottom spinner support arm (17) having a first end configured as vertical post receiver (17*a*) for attachment to the vertical post (3) and a second end configured with a shaft (17*c*) to support and engage with a rotatable fastener positioned therein;

e) At least one sign connected to and between the rotatable fastener cooperatively engaged with the lower side of the posterior connection stub (6*a*) and the bottom spinner support (17) wherein the at least one sign may rotate; and, f) wherein either the anterior stem or the posterior stem is configured to support connection to at least one additional fastener for attachment of at least one additional sign.

2. The sign post and sign system according to claim 1 wherein either the anterior stem or the posterior stem is configured for a plurality of fasteners attachable to at least point on either the anterior stem (8*a*) or the posterior stem (8*b*).

3. The sign post and sign system according to claim 2 wherein the length of the anterior stem (8*a*) is greater than the posterior stem (8*b*).

4. The sign post and sign system according to claim 1 wherein a light fork (15) for lighting at light one sign positioned proximate the light fork (15) is positioned proximate the vertical post (3) and the four-way connector (6).

5. The sign post and sign system according to claim 4 wherein the light fork (15) is configured with a vertical post receiver (15*a*) to surround and engage the vertical post (3) and at least one arm (15*c*) positioned proximate one of the horizontal stems (8).

6. The sign post and sign system according to claim 5 wherein the light fork is configured to engage a light fork stabilizer (16) at its opposite end, wherein the light fork stabilizer (16) is attached to the anterior stem (8*a*).

7. The sign post and sign system according to claim 4 wherein a light source and electrical connections are integrated into the light fork arms for connection to an electrical source located with the sign post and sign system.

8. The sign post and sign system according to claim 1 wherein a flyer box assembly (12) is configured to engage the vertical post (3) proximate the bottom spinner support (17).

9. The sign post and sign system according to claim 8 wherein the flyer box assembly (12) is configured with a transparent front portion with an access door positioned in the rear of the flyer box assembly, wherein the flyer box assembly engages and surrounds the vertical post (3).

10. The sign post and sign system according to claim 1 wherein at least one channel is positioned in the anterior horizontal stem (8*a*) in a lower position for engagement with at least one sign hook configured for engagement with the least one channel for attachment of at least one sign therein.

11. The sign post and sign system according to claim 1 wherein the upper connection stub of four-way connector (6) is configured as a non-removable cap 23.

12. The sign post and sign system according to claim 1 wherein a vertical connector (4) is positioned at the second end of the lower portion (3*b*) to allow engagement with the opening of the first end of the upper portion (3*a*) of the vertical post (3), wherein the vertical connector (4) is defined as having an exterior dimension less than the interior dimension of the opening of the first end of the upper portion (3*a*) of the vertical post (3).

13. The sign post and sign system according to claim 12 wherein the length of the anterior stem (8*a*) is greater than the posterior stem (8*b*).

14. The sign post and sign system according to claim 13 wherein a light fork (15) for lighting at least one sign positioned proximate the light fork (15) is positioned proximate the vertical post (3) and the four-way connector (6).

15. The sign post and sign system according to claim 14 wherein the light fork (15) is configured with a vertical post receiver (15*a*) to surround and engage the vertical post (3) and at least one arm (15*c*) positioned proximate one of the horizontal stems (8).

16. The sign post and sign system according to claim 15 wherein the light fork is configured to engage a light fork stabilizer (16) at its opposite end, wherein the light fork stabilizer (16) is attached to the anterior stem (8*a*).

17. The sign post and sign system according to claim 16 wherein a light source and electrical connections are integrated into the light fork arms for connection to an electrical source located with the sign post and sign system.

18. The sign post and sign system according to claim 17 wherein the flyer box assembly (12) is configured with an opening (12*c*) to engage and surround the vertical connector (4), the flyer box assembly (12) having a transparent front portion (46) with an access door (47) positioned in the rear of the flyer box assembly (12).

19. The sign post and sign system according to claim 1 wherein a hammer boot or a hammer plate may be engaged with base (1) for driving base lower portion (1*b*) into a support surface in support of erection of sign post and sign system.

20. The sign post and sign system according to claim 18 wherein a hammer boot or a hammer plate may be engaged with base (1) for driving base lower portion (1*b*) into a support surface in support of erection of sign post and sign system.

21. The sign post and sign system according to claim 1 wherein an aperture is positioned in said base to allow inclusion and use of ground surface fastener in further support of said base.

* * * * *